US010181287B2

(12) United States Patent
Miyake et al.

(10) Patent No.: US 10,181,287 B2
(45) **Date of Patent: *Jan. 15, 2019**

(54) LIGHT-EMITTING DEVICE

(71) Applicant: Semiconductor Energy Laboratory Co., Ltd., Atsugi-shi, Kanagawa-ken (JP)

(72) Inventors: Hiroyuki Miyake, Atsugi (JP); Shunpei Yamazaki, Setagaya (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/410,094

(22) Filed: Jan. 19, 2017

(65) Prior Publication Data

US 2017/0200413 A1 Jul. 13, 2017

Related U.S. Application Data

(63) Continuation of application No. 14/468,902, filed on Aug. 26, 2014, now Pat. No. 9,552,767.

(30) Foreign Application Priority Data

Aug. 30, 2013 (JP) ..... 2013-178817

(51) Int. Cl.
*H05B 37/02* (2006.01)
*G09G 3/3233* (2016.01)

(52) U.S. Cl.
CPC ... *G09G 3/3233* (2013.01); *G09G 2300/0819* (2013.01); *G09G 2300/0852* (2013.01);
(Continued)

(58) Field of Classification Search
CPC ..... G09G 3/3233; G09G 2300/0819; G09G 2320/0233; G09G 2320/045
(Continued)

(56) References Cited

U.S. PATENT DOCUMENTS 5,731,856 A 3/1998 Kim et al.
5,744,864 A 4/1998 Cillessen et al.
(Continued)

FOREIGN PATENT DOCUMENTS

EP 1737044 A 12/2006
EP 2226847 A 9/2010
(Continued)

OTHER PUBLICATIONS

Asakuma.N. et al., "Crystallization and Reduction of Sol-Gel-Derived Zinc Oxide Films by Irradiation with Ultraviolet Lamp", Journal of Sol-Gel Science and Technology, 2003, vol. 26, pp. 181-184.

(Continued)

*Primary Examiner* — Don P Le
(74) *Attorney, Agent, or Firm* — Robinson Intellectual Property Law Office; Eric J. Robinson

(57) ABSTRACT

A light-emitting device in which variation in luminance among pixels is suppressed. The light-emitting device includes a pixel; a first circuit configured to generate a signal containing information on a value of current extracted from the pixel; and a second circuit configured to correct an image signal in accordance with the signal. The pixel includes a light-emitting element; a transistor for controlling supply of the current to the light-emitting element in accordance with the image signal; a first switch configured to control connection between a gate and a drain of the transistor or between the gate of the transistor and a wiring; and a second switch configured to control extraction of the current from the pixel.

12 Claims, 20 Drawing Sheets

(52) U.S. Cl.
CPC ..... *G09G 2300/0861* (2013.01); *G09G 2320/0233* (2013.01); *G09G 2320/045* (2013.01)

(58) Field of Classification Search
USPC ..... 315/226, 291
See application file for complete search history.

(56) References Cited

U.S. PATENT DOCUMENTS 6,294,274 B1 9/2001 Kawazoe et al.
6,563,174 B2 5/2003 Kawasaki et al.
6,727,522 B1 4/2004 Kawasaki et al.
7,049,190 B2 5/2006 Takeda et al.
7,061,014 B2 6/2006 Hosono et al.
7,064,346 B2 6/2006 Kawasaki et al.
7,105,868 B2 9/2006 Nause et al.
7,199,768 B2 4/2007 Ono et al.
7,211,825 B2 5/2007 Shih et al.
7,282,782 B2 10/2007 Hoffman et al.
7,297,977 B2 11/2007 Hoffman et al.
7,323,356 B2 1/2008 Hosono et al.
7,385,224 B2 6/2008 Ishii et al.
7,402,506 B2 7/2008 Levy et al.
7,411,209 B2 8/2008 Endo et al.
7,453,065 B2 11/2008 Saito et al.
7,453,087 B2 11/2008 Iwasaki
7,462,862 B2 12/2008 Hoffman et al.
7,468,304 B2 12/2008 Kaji et al.
7,501,293 B2 3/2009 Ito et al.
7,619,597 B2 11/2009 Nathan et al.
7,674,650 B2 3/2010 Akimoto et al.
7,732,819 B2 6/2010 Akimoto et al.
7,834,826 B2 11/2010 Kwon
8,026,876 B2 9/2011 Nathan et al.
8,199,074 B2 6/2012 Wang et al.
8,212,581 B2 7/2012 Levey et al.
8,274,457 B2 9/2012 Tsai
8,384,629 B2 2/2013 Shimoda
8,982,020 B2 3/2015 Sun et al.
9,123,296 B2 9/2015 Nam et al.
2001/0046027 A1 11/2001 Tai et al.
2002/0056838 A1 5/2002 Ogawa
2002/0132454 A1 9/2002 Ohtsu et al.
2003/0189401 A1 10/2003 Kido et al.
2003/0218222 A1 11/2003 Wager, III et al.
2004/0038446 A1 2/2004 Takeda et al.
2004/0127038 A1 7/2004 Carcia et al.
2005/0017302 A1 1/2005 Hoffman
2005/0199959 A1 9/2005 Chiang et al.
2006/0035452 A1 2/2006 Carcia et al.
2006/0043377 A1 3/2006 Hoffman et al.
2006/0091793 A1 5/2006 Baude et al.
2006/0108529 A1 5/2006 Saito et al.
2006/0108636 A1 5/2006 Sano et al.
2006/0110867 A1 5/2006 Yabuta et al.
2006/0113536 A1 6/2006 Kumomi et al.
2006/0113539 A1 6/2006 Sano et al.
2006/0113549 A1 6/2006 Den et al.
2006/0113565 A1 6/2006 Abe et al.
2006/0169973 A1 8/2006 Isa et al.
2006/0170111 A1 8/2006 Isa et al.
2006/0197092 A1 9/2006 Hoffman et al.
2006/0208977 A1 9/2006 Kimura
2006/0228974 A1 10/2006 Thelss et al.
2006/0231882 A1 10/2006 Kim et al.
2006/0238135 A1 10/2006 Kimura
2006/0244107 A1 11/2006 Sugihara et al.
2006/0256048 A1 11/2006 Fish et al.
2006/0284171 A1 12/2006 Levy et al.
2006/0284172 A1 12/2006 Ishii
2006/0292777 A1 12/2006 Dunbar
2007/0024187 A1 2/2007 Shin et al.
2007/0024540 A1 2/2007 Ryu et al.
2007/0046191 A1 3/2007 Saito
2007/0052025 A1 3/2007 Yabuta
2007/0054507 A1 3/2007 Kaji et al.
2007/0090365 A1 4/2007 Hayashi et al.
2007/0108446 A1 5/2007 Akimoto
2007/0152217 A1 7/2007 Lai et al.
2007/0172591 A1 7/2007 Seo et al.
2007/0187678 A1 8/2007 Hirao et al.
2007/0187760 A1 8/2007 Furuta et al.
2007/0194379 A1 8/2007 Hosono et al.
2007/0252928 A1 11/2007 Ito et al.
2007/0272922 A1 11/2007 Kim et al.
2007/0287296 A1 12/2007 Chang
2008/0006877 A1 1/2008 Mardilovich et al.
2008/0038882 A1 2/2008 Takechi et al.
2008/0038929 A1 2/2008 Chang
2008/0050595 A1 2/2008 Nakagawara et al.
2008/0073653 A1 3/2008 Iwasaki
2008/0083950 A1 4/2008 Pan et al.
2008/0106191 A1 5/2008 Kawase
2008/0128689 A1 6/2008 Lee et al.
2008/0129195 A1 6/2008 Ishizaki et al.
2008/0166834 A1 7/2008 Kim et al.
2008/0182358 A1 7/2008 Cowdery-Corvan et al.
2008/0224133 A1 9/2008 Park et al.
2008/0254569 A1 10/2008 Hoffman et al.
2008/0258139 A1 10/2008 Ito et al.
2008/0258140 A1 10/2008 Lee et al.
2008/0258141 A1 10/2008 Park et al.
2008/0258143 A1 10/2008 Kim et al.
2008/0296568 A1 12/2008 Ryu et al.
2009/0068773 A1 3/2009 Lai et al.
2009/0073325 A1 3/2009 Kuwabara et al.
2009/0114910 A1 5/2009 Chang
2009/0134399 A1 5/2009 Sakakura et al.
2009/0152506 A1 6/2009 Umeda et al.
2009/0152541 A1 6/2009 Maekawa et al.
2009/0166616 A1* 7/2009 Uchiyama ..... H01L 29/7869 257/43
2009/0278122 A1 11/2009 Hosono et al.
2009/0280600 A1 11/2009 Hosono et al.
2010/0065844 A1 3/2010 Tokunaga
2010/0073357 A1* 3/2010 Min ..... G09G 3/3233 345/214
2010/0092800 A1 4/2010 Itagaki et al.
2010/0109002 A1 5/2010 Itagaki et al.
2010/0118014 A1* 5/2010 Toyomura ..... G09G 3/3233 345/211
2010/0253659 A1 10/2010 Sugimoto et al.
2011/0130981 A1 6/2011 Chaji et al.
2013/0021316 A1 1/2013 Inoue et al.
2013/0092930 A1 4/2013 Kimura
2013/0147690 A1 6/2013 Kim et al.
2013/0241431 A1 9/2013 Toyotaka et al.
2014/0333604 A1* 11/2014 Omoto ..... G09G 3/3233 345/212
2015/0002502 A1 1/2015 Kim
2015/0145434 A1 5/2015 Jang

FOREIGN PATENT DOCUMENTS

JP 60-198861 A 10/1985
JP 63-210022 A 8/1988
JP 63-210023 A 8/1988
JP 63-210024 A 8/1988
JP 63-215519 A 9/1988
JP 63-239117 A 10/1988
JP 63-265818 A 11/1988
JP 05-251705 A 9/1993
JP 08-264794 A 10/1996
JP 11-505377 5/1999
JP 2000-044236 A 2/2000
JP 2000-150900 A 5/2000
JP 2002-076356 A 3/2002
JP 2002-289859 A 10/2002
JP 2003-086000 A 3/2003
JP 2003-086808 A 3/2003
JP 2004-103957 A 4/2004
JP 2004-273614 A 9/2004
JP 2004-273732 A 9/2004

(56) References Cited

FOREIGN PATENT DOCUMENTS

| | | | |
|---|---|---|---|
| JP | 2004-280059 | A | 10/2004 |
| JP | 2010-500620 | | 1/2010 |
| JP | 2010-243645 | A | 10/2010 |
| JP | 2011-028214 | A | 2/2011 |
| JP | 2012-150490 | A | 8/2012 |
| JP | 2013-512473 | | 4/2013 |
| WO | WO-2004/114391 | | 12/2004 |

OTHER PUBLICATIONS

Asaoka.Y et al., "29.1:Polarizer-Free Reflective LCD Combined With Ultra Low-Power Driving Technology", SID Digest '09 : SID International Symposium Digest of Technical Papers, May 31, 2009, pp. 395-398.

Chern.H et al., "An Analytical Model for the Above-Threshold Characteristics of Polysilicon Thin-Film Transistors", IEEE Transactions on Electron Devices, Jul. 1, 1995, vol. 42, No. 7, pp. 1240-1246.

Cho.D et al., "21.2:Al and Sn-Doped Zinc Indium Oxide Thin Film Transistors for AMOLED Backplane", SID Digest '09 : SID International Symposium Digest of Technical Papers, May 31, 2009, pp. 280-283.

Clarks et al., "First Principles Methods Using Castep", Zeitschrift fur Kristallographie, 2005, vol. 220, pp. 567-570.

Coates.D et al., "Optical Studies of the Amorphous Liquid-Cholesteric Liquid Crystal Transition:The "Blue Phase"", Physics Letters, Sep. 10, 1973, vol. 45A, No. 2, pp. 115-116.

Costello.M et al., "Electron Microscopy of a Cholesteric Liquid Crystal and Its Blue Phase", Phys. Rev. A (Physical Review. A), May 1, 1984, vol. 29, No. 5, pp. 2957-2959.

Dembo.H et al., "RFCPUS on Glass and Plastic Substrates Fabricated by TFT Transfer Technology", IEDM 05: Technical Digest of International Electron Devices Meeting, Dec. 5, 2005, pp. 1067-1069.

Fortunato.E et al., "Wide-Bandgap High-Mobility ZnO Thin-Film Transistors Produced at Room Temperature", Appl. Phys. Lett. (Applied Physics Letters) , Sep. 27, 2004, vol. 85, No. 13, pp. 2541-2543.

Fung.T et al., "2-D Numerical Simulation of High Performance Amorphous In—Ga—Zn—O TFTs for Flat Panel Displays", AM-FPD '08 Digest of Technical Papers, Jul. 2, 2008, pp. 251-252, The Japan Sociey of Applied Physics.

Godo.H et al., "P-9:Numerical Analysis on Temperature Dependence of Characteristics of Amorphous In—Ga—Zn-Oxide TFT", SID Digest '09 : SID International Symposium Digest of Technical Papers, May 31, 2009, pp. 1110-1112.

Godo.H et al., "Temperature Dependence of Characteristics and Electronic Structure for Amorphous In—Ga—Zn-Oxide TFT", AM-FPD '09 Digest of Technical Papers, Jul. 1, 2009, pp. 41-44.

Hayashi.R et al., "42.1: Invited Paper: Improved Amorphous In—Ga—Zn—O TFTs", SID Digest '08 : SID International Symposium Digest of Technical Papers, May 20, 2008, vol. 39, pp. 621-624.

Hirao.T et al., "Novel Top-Gate Zinc Oxide Thin-Film Transistors (ZnO TFTs) for AMLCDs", J. Soc. Inf. Display (Journal of the Society for Information Display), 2007, vol. 15, No. 1, pp. 17-22.

Hosono.H et al., "Working hypothesis to explore novel wide band gap electrically conducting amorphous oxides and examples", J. Non-Cryst. Solids (Journal of Non-Crystalline Solids), 1996, vol. 198-200, pp. 165-169.

Hosono.H, "68.3:Invited Paper:Transparent Amorphous Oxide Semiconductors for High Performance TFT", SID Digest '07 : SID International Symposium Digest of Technical Papers, 2007, vol. 38, pp. 1830-1833.

Hsieh.H et al., "P-29:Modeling of Amorphous Oxide Semiconductor Thin Film Transistors and Subgap Density of States", SID Digest '08 : SID International Symposium Digest of Technical Papers, May 20, 2008, vol. 39, pp. 1277-1280.

Ikeda.T et al., "Full-Functional System Liquid Crystal Display Using CG-Silicon Technology", SID Digest '04 : SID International Symposium Digest of Technical Papers, 2004, vol. 35, pp. 860-863.

Janotti.A et al., "Native Point Defects in ZnO", Phys. Rev. B (Physical Review. B), Oct. 4, 2007, vol. 76, No. 16, pp. 165202-1-165202-22.

Janotti.A et al., "Oxygen Vacancies in ZnO", Appl. Phys. Lett. (Applied Physics Letters) , 2005, vol. 87, pp. 122102-1-122102-3.

Jeong.J et al., "3.1: Distinguished Paper: 12.1-Inch WXGA AMOLED Display Driven by Indium-Gallium-Zinc Oxide TFTs Array", SID Digest '08 : SID International Symposium Digest of Technical Papers, May 20, 2008, vol. 39, No. 1, pp. 1-4.

Jin.D et al., "65.2:Distinguished Paper:World-Largest (6.5") Flexible Full Color Top Emission AMOLED Display on Plastic Film and Its Bending Properties", SID DIgest '09 : SID International Symposium Digest of Technical Papers, May 31, 2009, pp. 983-985.

Kanno.H et al., "White Stacked Electrophosphorecent Organic Light-Emitting Devices Employing MOO3 as a Charge-Generation Layer", Adv. Mater. (Advanced Materials), 2006, vol. 18, No. 3, pp. 339-342.

Kikuchi.H et al., "39.1:Invited Paper:Optically Isotropic Nano-Structured Liquid Crystal Composites for Display Applications", SID Digest '09 : SID International Symposium Digest of Technical Papers, May 31, 2009, pp. 578-581.

Kikuchlh et al., "62.2:Invited Paper:Fast Electro-Optical Switching in Polymer-Stabilized Liquid Crystalline Blue Phases for Display Application", SID Digest '07 : SID International Symposium Digest of Technical Papers, 2007, vol. 38, pp. 1737-1740.

Kikuchi.H et al., "Polymer-Stabilized Liquid Crystal Blue Phases", Nature Materials, Sep. 2, 2002, vol. 1, pp. 64-68.

Kim.S et al., "High-Performance oxide thin film transistors passivated by various gas plasmas", 214th ECS Meeting, 2008, No. 2317, ECS.

Kimizuka.N. et al., "Spinel,YBFe2O4, and YB2Fe3O7 Types of Structures for Compounds in the In2O3 and Sc2O3—A2O3—BO Systems [A; Fe, Ga, or Al; B: Mg, Mn, Fe, Ni, Cu,or Zn]At Temperatures Over 1000° C.", Journal of Solid State Chemistry, 1985, vol. 60, pp. 382-384.

Kimizuka.N. et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3—ZnGa2O4—ZnO System", Journal of Solid State Chemistry, Apr. 1, 1995, vol. 116, No. 1, pp. 170-178.

Kitzerow.H et al., "Observation of Blue Phases in Chiral Networks", Liquid Crystals, 1993, vol. 14, No. 3, pp. 911-916.

Kurokawa.Y et al., "UHF RFCPUS on Flexible and Glass Substrates for Secure RFID Systems", Journal of Solid-State Circuits , 2008, vol. 43, No. 1, pp. 292-299.

Lany.S et at., "Dopability, Intrinsic Conductivity, and Nonstoichiometry of Transparent Conducting Oxides", Phys. Rev. Lett. (Physical Review Letters), Jan. 26, 2007, vol. 98, pp. 045501-1-045501-4.

Lee.H et al., "Current Status of, Challenges to, and Perspective View of AM-OLED ", IDW '06 : Proceedings of the 13th International Display Workshops, Dec. 7, 2006, pp. 663-666.

Lee.J et al., "World'S Largest (15-Inch) XGA AMLCD Panel Using IGZO Oxide TFT", SID Digest '08 : SID International Symposium Digest of Technical Papers, May 20, 2008, vol. 39, pp. 625-628.

Lee.M et al., "15.4:Excellent Performance of Indium-Oxide-Based Thin-Film Transistors by DC Sputtering", SID Digest '09 : SID International Symposium Digest of Technical Papers, May 31, 2009, pp. 191-193.

Li.C et al., "Modulated Structures of Homologous Compounds InMO3(ZnO)m (M=In,Ga; m=Integer) Described by Four-Dimensional Superspace Group", Journal of Solid State Chemistry, 1998, vol. 139, pp. 347-355.

Masuda.S et al., "Transparent thin film transistors using ZnO as an active channel layer and their electrical properties", J. Appl. Phys. (Journal of Applied Physics) , Feb. 1, 2003, vol. 93, No. 3, pp. 1624-1630.

Meiboom.S et al., "Theory of the Blue Phase of Cholesteric Liquid Crystals", Phys. Rev. Lett. (Physical Review Letters), May 4, 1981, vol. 46, No. 18, pp. 1216-1219.

Miyasaka.M, "SUFTLA Flexible Microelectronics on Their Way to Business", SID Digest '07 : SID International Symposium Digest of Technical Papers, 2007, vol. 38, pp. 1673-1676.

(56) References Cited

OTHER PUBLICATIONS

Mo.Y et al., "Amorphous Oxide TFT Backplanes for Large Size AMOLED Displays", IDW '08 : Proceedings of the 6th International Display Workshops, Dec. 3, 2008, pp. 581-584.
Nakamura.M et al., "The phase relations in the In2O3—Ga2ZnO4—ZnO system at 1350° C.", Journal of Solid State Chemistry, Aug. 1, 1991, vol. 93, No. 2, pp. 298-315.
Nakamura.M, "Synthesis of Homologous Compound with New Long-Period Structure", Nirim Newsletter, Mar. 1, 1995, vol. 150, pp. 1-4.
Nomura.K et al., "Amorphous Oxide Semiconductors for High-Performance Flexible Thin-Film Transistors", Jpn. J. Appl. Phys. (Japanese Journal of Applied Physics) , 2006, vol. 45, No. 5B, pp. 4303-4308.
Nomura.K et al., "Carrier transport in transparent oxide semiconductor with intrinsic structural randomness probed using single-crystalline InGaO3(ZnO)5 films", Appl. Phys. Lett. (Applied Physics Letters) , Sep. 13, 2004, vol. 85, No. 11, pp. 1993-1995.
Nomura.K et al., "Room-Temperature Fabrication of Transparent Flexible Thin-Film Transistors Using Amorphous Oxide Semiconductors", Nature, Nov. 25, 2004, vol. 432, pp. 488-492.
Nomura.K et al., "Thin-Film Transistor Fabricated in Single-Crystalline Transparent Oxide Semiconductor", Science, May 23, 2003, vol. 300, No. 5623, pp. 1269-1272.
Nowatari.H et al., "60.2: Intermediate Connector With Suppressed Voltage Loss for White Tandem OLEDs", SID Digest '09 : SID International Symposium Digest of Technical Papers, May 31, 2009, vol. 40, pp. 899-902.
Oba.F et al., "Defect energetics in ZnO: A hybrid Hartree-Fock density functional study", Phys. Rev. B (Physical Review. B), 2008, vol. 77, pp. 245202-1-245202-6.
Oh.M et al., "Improving the Gate Stability of ZnO Thin-Film Transistors With Aluminum Oxide Dielectric Layers", J. Electrochem. Soc. (Journal of the Electrochemical Society), 2008, vol. 155, No. 12, pp. H1009-H1014.
Ohara.H et al., "21.3:4.0 In. QVGA AMOLED Display Using In—Ga—Zn-Oxide TFTs With a Novel Passivation Layer", SID Digest '09 : SID International Symposium Digest of Technical Papers, May 31, 2009, pp. 284-287.
Ohara.H et al., "Amorphous In—Ga—Zn-Oxide TFTs with Suppressed Variation for 4.0 inch QVGA AMOLED Display", AM-FPD '09 Digest of Technical Papers, Jul. 1, 2009, pp. 227-230, The Japan Society of Applied Physics.
Orita.M et al., "Amorphous transparent conductive oxide InGaO3(ZnO)m (m<4):a Zn4s conductor", Philosophical Magazinge, 2001, vol. 81, No. 5, pp. 501-515.
Orita.M et al., "Mechanism of Electrical Conductivity of Transparent InGaZnO4", Phys. Rev. B (Physical Review. B), Jan. 15, 2000, vol. 61, No. 3, pp. 1811-1816.
Osada.T et al., "15.2: Development of Driver-Integrated Panel using Amorphous In—Ga—Zn-Oxide TFT", SID Digest '09 : SID International Symposium Digest of Technical Papers, May 31, 2009, vol. 40, pp. 184-187.
Osada.T et al., "Development of Driver-Integrated Panel Using Amorphous In—Ga—Zn-Oxide TFT", AM-FPD '09 Digest of Technical Papers, Jul. 1, 2009, pp. 33-36.
Park.J et al., "Amorphous Indium-Gallium-Zinc Oxide TFTs and Their Application for Large Size AMOLED", AM-FPD '08 Digest of Technical Papers, Jul. 2, 2008, pp. 275-278.
Park.J et al., "Dry etching of ZnO films and plasma-induced damage to optical properties", J. Vac. Sci. Technol. B (Journal of Vacuum Science & Technology B), Mar. 1, 2003, vol. 21, No. 2, pp. 800-803.
Park.J et al "Electronic Transport Properties of Amorphous Indium-Gallium-Zinc Oxide Semiconductor Upon Exposure to Water", Appl. Phys. Lett. (Applied Physics Letters) , 2008, vol. 92, pp. 072104-1-072104-3.
Park.J et al., "High performance amorphous oxide thin film transistors with self-aligned top-gate structure", IEDM 09: Technical Digest of International Electron Devices Meeting, Dec. 7, 2009, pp. 191-194.
Park.J et al,, "Improvements in the Device Characteristics of Amorphous Indium Gallium Zinc Oxide Thin-Film Transistors by Ar Plasma Treatment", Appl. Phys. Lett. (Applied Physics Letters) , Jun. 26, 2007, vol. 90, No. 26, pp. 262106-1-262106-3.
Park.S et al., "Challenge to Future Displays: Transparent AM-OLED Driven by Peald Grown ZnO TFT", IMID '07 Digest, 2007, pp. 1249-1252.
Park.Sang-Hee et al., "42.3: Transparent ZnO Thin Film Transistor for the Application of High Aperture Ratio Bottom Emission AM-OLED Display", SID Digest '08 : SID International Symposium Digest of Technical Papers, May 20, 2008, vol. 39, pp. 629-632.
Prins.M et al., "A Ferroelectric Transparent Thin-Film Transistor", Appl. Phys. Lett. (Applied Physics Letters) , Jun. 17, 1996, vol. 68, No. 25, pp. 3650-3652.
Sakata.J et al., "Development of 4.0-In. AMOLED Display With Driver Circuit Using Amorphous In—Ga—Zn-Oxide TFTs", IDW '09 : Proceedings of the 16th International Display Workshops, 2009, pp. 689-692.
Son.K et al., "42.4L: Late-News Paper: 4 Inch QVGA AMOLED Driven by the Threshold Voltage Controlled Amorphous GIZO (Ga2O3—In2O3—ZnO) TFT", SID Digest '08 : SID International Symposium Digest of Technical Papers, May 20, 2008, vol. 39, pp. 633-636.
Takahashi.M et al., "Theoretical Analysis of IGZO Transparent Amorphous Oxide Semiconductor", IDW '08 : Proceedings of the 15th International Display Workshops, Dec. 3, 2008, pp. 1637-1640.
Tsuda.K et at., "Ultra Low Power Consumption Technologies for Mobile TFT-LCDs ", IDW '02 : Proceedings of the 9th International Display Workshops, Dec. 4, 2002, pp. 295-298.
Ueno.K et al., "Field-Effect Transistor on SrTiO3 With Sputtered Al2O3 Gate Insulator", Appl. Phys. Lett. (Applied Physics Letters) , Sep. 1, 2003, vol. 83, No. 9, pp. 1755-1757.
Van de Walle.C, "Hydrogen as a Cause of Doping in Zinc Oxide", Phys. Rev. Lett. (Physical Review Letters), Jul. 31, 2000, vol. 85, No. 5, pp. 1012-1015.

* cited by examiner

LIGHT-EMITTING DEVICE

BACKGROUND OF THE INVENTION

1. Field of the Invention

The present invention relates to an object, a method, or a manufacturing method. The present invention relates to a process, a machine, manufacture, or a composition of matter. In particular, one embodiment of the present invention relates to a semiconductor device, a display device, a light-emitting device, a driving method thereof, or a manufacturing method thereof one embodiment of the present invention relates to a light-emitting device in which a transistor is provided in each pixel.

2. Description of the Related Art

In an active matrix light-emitting device including light-emitting elements, in general, at least a light-emitting element, a transistor (a switching transistor) that controls input of image signals to pixels, and a transistor (a driving transistor) that controls the value of current supplied to the light-emitting element in response to an image signal are provided in each pixel. In a light-emitting device having the above structure, drain current of a driving transistor is supplied to a light-emitting element; thus, when the threshold voltage of driving transistors varies among pixels, the luminance of light-emitting elements varies correspondingly.

Patent Document 1 discloses a display device in which the threshold voltage of a TFT (a driver element) is corrected inside a pixel so that variations in threshold voltages do not influence the luminance of a light-emitting element. Patent Document 2 to 4 disclose display devices for monitoring outside the pixels.

REFERENCE

Patent Document

[Patent Document 1] Japanese Published Patent Application No. 2004-280059

[Patent Document 2] Japanese Translation of PCT International Application No. 2013-512473

[Patent Document 3] Japanese Published Patent Application No. 2012-150490

[Patent Document 4] Japanese Translation of PCT International Application No. 2010-500620

SUMMARY OF THE INVENTION

Not only threshold voltage but also other electrical characteristics of a driving transistor, such as mobility, relate to drain current of the driving transistor. It is thus difficult to suppress luminance unevenness of a light-emitting element with such a structure as in Patent Document 1 for correcting only variation in drain current due to variation in threshold voltages. In order to improve image quality of a light-emitting device, it is important to correct variation in drain current of driving transistors due to variation in threshold voltages and mobility.

In view of the foregoing technical background, an object of one embodiment of the present invention is to provide a light-emitting device capable of suppressing variation or degradation in luminance among pixels due to electrical characteristics of driving transistors. Another object of one embodiment of the present invention is to provide a light-emitting device capable of reducing the influence of variation or degradation of mobility of driving transistors.

Another object of one embodiment of the present invention is to provide a light-emitting device capable of reducing the influence of variation or degradation of light-emitting elements. Another object of one embodiment of the present invention is to provide a light-emitting device in which the amplitude of an image signal is not too large. Another object of one embodiment of the present invention is to provide a light-emitting device in which the number of bits of an image signal is not too large. Another object of one embodiment of the present invention is to provide a light-emitting device with less power consumption. Another object of one embodiment of the present invention is to provide a light-emitting device having a correction method which is a combination of a plurality of methods. Another object of one embodiment of the present invention is to provide a novel light-emitting device.

Note that the descriptions of these objects do not disturb the existence of other objects. In one embodiment of the present invention, there is no need to achieve all the objects. Other objects will be apparent from and can be derived from the description of the specification, the drawings, the claims, and the like.

A light-emitting device of one embodiment of the present invention has not only a structure for correcting threshold voltages of driving transistors in pixels but also a structure for correcting image signals outside the pixels so that drain current of driving transistors can approach appropriate values. With these structures, variation in drain current of driving transistors due to not only variation in threshold voltages of driving transistors but also variation in electrical characteristics other than threshold voltage, such as mobility, can be corrected.

A light-emitting device according to one embodiment of the present invention includes a pixel; a first circuit configured to generate a signal containing information on a value of current extracted from the pixel; and a second circuit configured to correct an image signal in accordance with the signal. The pixel includes a light-emitting element; a transistor for controlling supply of the current to the light-emitting element in accordance with the image signal; a first switch configured to control connection between a gate and a drain of the transistor or between the gate of the transistor and a wiring; and a second switch configured to control extraction of the current from the pixel.

One embodiment of the present invention can provide a light-emitting device capable of suppressing variation in luminance among pixels due to electrical characteristics of driving transistors.

DETAILED DESCRIPTION OF THE INVENTION

Figure 1:
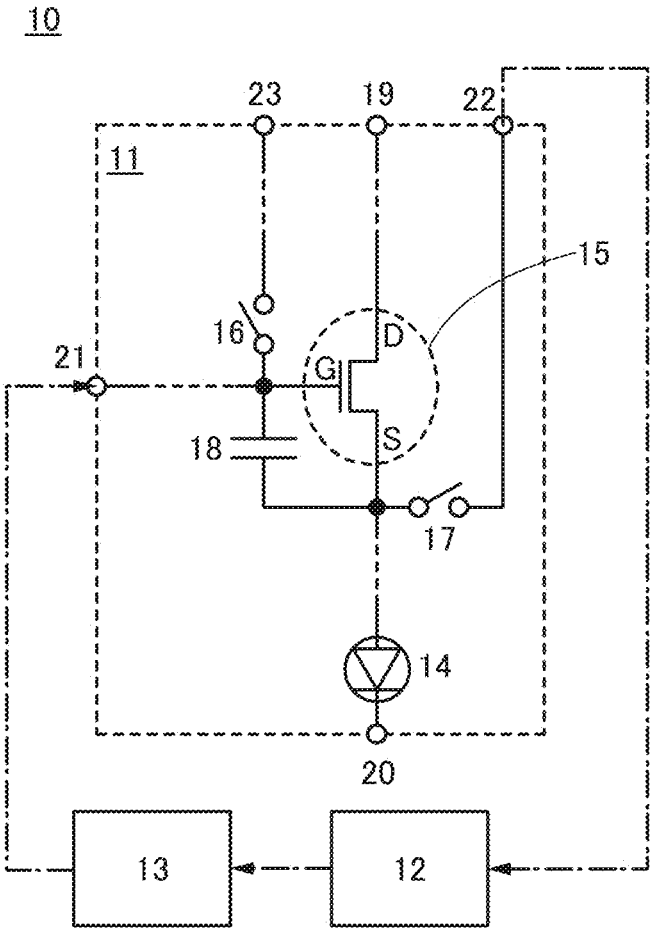
FIG. 1 illustrates a structure of a light-emitting device.

Embodiments of the present invention will be described below in detail with reference to the drawing. Note that the present invention is not limited to the following description, and it is easily understood by those skilled in the art that the mode and details can be variously changed without departing from the spirit and scope of the present invention. Therefore, the present invention should not be construed as being limited to the description of the embodiments below.

Note that the term "connection" in this specification refers to electrical connection and corresponds to a state of a circuit configuration in which current, voltage, or a potential can be supplied or transmitted. Accordingly, a connection circuit means not only a state of direct connection but also a state of electrical connection through an element such as a wiring, a resistor, a diode, or a transistor so that current, voltage, or a potential can be supplied or transmitted.

Even when different components are connected to each other in a circuit diagram, there is actually a case where one conductive film has functions of a plurality of components such as a case where part of a wiring serves as an electrode. The term "connection" also means such a case where one conductive film has functions of a plurality of components.

A source of a transistor means a source region that is part of a semiconductor film functioning as the semiconductor film or a source electrode that is electrically connected to the semiconductor film. Similarly, a drain of a transistor sometimes means a drain region that is part of a semiconductor film functioning as the semiconductor film or a drain electrode electrically connected to the semiconductor film. A gate means a gate electrode.

The terms "source" and "drain" of a transistor interchange with each other depending on the conductivity type of the transistor or levels of potentials applied to terminals. In general, in an n-channel transistor, a terminal to which a lower potential is applied is called a source, and a terminal to which a higher potential is applied is called a drain. Further, in a p-channel transistor, a terminal to which a lower potential is applied is called a drain, and a terminal to which a higher potential is applied is called a source. In this specification, although connection relation of the transistor is described assuming that the source and the drain are fixed in some cases for convenience, actually, the names of the source and the drain interchange with each other depending on the relation of the potentials.

In this specification and the like, a variety of switches can be used as a switch. The switch has a function of determining whether current flows or not by being turned on or off (being brought into an on state or an off state). Alternatively, the switch has a function of selecting and changing a current path; for example, a function of determining whether current can flow through a path 1 or a path 2 and switching the paths. For example, an electrical switch, a mechanical switch, or the like can be used. That is, any element can be used as a switch as long as it can control current, without particular limitation. Another example is a transistor (e.g., a bipolar transistor or a MOS transistor), a diode (e.g., a PN diode, a PIN diode, a Schottky diode, an MIM (metal insulator metal) diode, an MIS (metal insulator semiconductor) diode, or a diode-connected transistor), a logic circuit in which such elements are combined, or the like. An example of a mechanical switch is a switch formed using a MEMS (micro electro mechanical system) technology, such as a digital micromirror device (DMD). Such a switch includes an electrode which can be moved mechanically, and operates by controlling conduction in accordance with movement of the electrode.

<Structure Example of Light-Emitting Device>

FIG. 1 illustrates a structure example of a light-emitting device of one embodiment of the present invention. A light-emitting device 10 in FIG. 1 includes a pixel 11, a monitor circuit 12, and an image processing circuit 13. The pixel 11 includes at least a light-emitting element 14, a transistor 15, a switch 16, a switch 17, and a capacitor 18.

Examples of the light-emitting elements 14 include an element whose luminance is controlled by current or voltage, such as a light-emitting diode (LED) or an organic light-emitting diode (OLED). An OLED includes at least an EL layer, an anode, and a cathode. The EL layer is formed using a single layer or plural layers provided between the anode and the cathode, at least one of which is a light-emitting layer containing a light-emitting substance. From the EL layer, electroluminescence is obtained by current supplied when a potential difference between the cathode and the anode is higher than or equal to a threshold voltage Vthe of the light-emitting element 14. As electroluminescence, there are luminescence (fluorescence) at the time of returning from a singlet-excited state to a ground state and luminescence (phosphorescence) at the time of returning from a triplet-excited state to a ground state.

The transistor 15 has a function of controlling the current supply to the light-emitting element 14 in accordance with image signals input to the pixel 11 through a wiring 21. Note that the transistor 15 may have a backgate (a second gate) for controlling threshold voltage in addition to a normal gate (a first gate).

In FIG. 1, the transistor 15 is an n-channel transistor, and a source of the transistor 15 is connected to an anode of the light-emitting element 14. A drain of the transistor 15 is connected to a wiring 19, and a cathode of the light-emitting element 14 is connected to a wiring 20. The potential of the wiring 20 is higher than the sum of the potential of the wiring 19, the threshold voltage Vthe of the light-emitting element 14, and the threshold voltage Vth of the transistor 15. Thus, when the value of the drain current of the transistor 15 is determined in response to an image signal input to the pixel 11, the light-emitting element 14 emits light by supply of the drain current to the light-emitting element 14. The luminance of the light-emitting element 14 is determined by the value of the drain current.

In the case where the transistor 15 is a p-channel transistor, the source of the transistor 15 is connected to the cathode of the light-emitting element 14. The drain of the transistor 15 is connected to the wiring 19, and the anode of the light-emitting element 14 is connected to the wiring 20. The potential of the wiring 20 is higher than the sum of the potential of the wiring 19, the threshold voltage Vthe of the light-emitting element 14, and the threshold voltage Vth of the transistor 15. As in the case where the transistor 15 is an n-channel transistor, in the case where the transistor 15 is a p-channel transistor, when the value of the drain current of the transistor 15 is determined in response to an image signal input to the pixel 11, the light-emitting element 14 emits light by supply of the drain current to the light-emitting element 14. The luminance of the light-emitting element 14 is determined by the value of the drain current.

The switch 16 controls conduction between a gate of the transistor 15 (denoted by G) and a wiring 23. The switch 16 can be composed of one or more transistors, for example. A capacitor may be included in addition to one or more transistors. The switch 17 controls the extraction of drain current flowing through the transistor 15 from the pixel 11. The switch 17 can be composed of one or more transistors. Specifically, the switch 17 controls conduction between the wiring 22 and the source of the transistor 15.

The wiring 23 may be electrically connected to the wiring 19. In that case, the switch 16 controls conduction between the gate and a drain (denoted by D) of the transistor 15. Alternatively, the wiring 23 may be electrically isolated from the wiring 19. In either case, when the transistor 15 is an n-channel transistor, the potential of the wiring 23 is higher than a potential obtained by adding the threshold voltage Vthe of the light-emitting element 14 and the threshold voltage Vth of the transistor 15 to the potential of the wiring 20. When the transistor 15 is a p-channel transistor, the potential of the wiring 23 is lower than a potential obtained by subtracting the threshold voltage Vthe of the light-emitting element 14 and the threshold voltage Vth of the transistor 15 from the potential of the wiring 20.

The capacitor 18 holds a potential difference between the gate electrode and a source terminal (represented by S) of the transistor 15, that is, gate voltage Vgs. Note that the capacitor 18 is not necessarily provided in the pixel 11 when gate capacitance formed between the gate and the semiconductor film of the transistor 15 is sufficiently high, for example.

In one embodiment of the present invention, before the value of the drain current of the transistor 15 is determined in response to an image signal, the threshold voltage of the transistor 15 is acquired while the gate of the transistor 15 is electrically connected to the wiring 23 with the switch 16 in the pixel 11. Alternatively, the threshold voltage of the transistor 15 is acquired while the gate is electrically connected to the drain of the transistor 15 with the switch 16. By determining the value of the drain current of the transistor 15 in response to an image signal after the threshold voltage is acquired, variations in threshold voltage among pixels 11 can be prevented from influencing the value of the drain current.

In the case where the transistor 15 is an n-channel transistor, before the threshold voltage is acquired, the wiring 23 is kept at a potential higher than the potential of the source of the transistor 15. Specifically, a potential difference Von is produced between the source of the transistor 15 and the wiring 23 so that the potential of the wiring 23 is higher than the sum of the potential of the source terminal of the transistor 15 and the threshold voltage Vth of the transistor 15. The gate voltage Vgs of the transistor 15 is thus equal to the potential difference Von, and the transistor 15 is turned on and drain current flows.

Next, the source of the transistor 15 becomes in a floating state so that the drain current of the transistor 15 flows only to the capacitor 18. Consequently, electric charge accumulated in the capacitor 18 is released, so that the potential of the source of the transistor 15 is increased. The gate voltage Vgs of the transistor 15 is equal to the potential difference Von at the beginning of the supply of drain current, but gradually decreases with the increase in potential of the source. As the gate voltage Vgs of the transistor 15 approaches the threshold voltage Vth, the drain current converges to 0 A. The threshold voltage Vth is held in the capacitor 18, and the acquisition of the threshold voltage Vth is completed.

Through the series of operations, variations in threshold voltage of the transistors 15 among the pixels 11 can be corrected, and variations in luminance of the light-emitting elements 14 among the pixels 11 can be suppressed.

As described above, in one embodiment of the present invention, the pixel 11 can have any structure as long as conduction between the gate of the transistor 15 and the wiring 23 can be controlled with the switch 16. Furthermore, in one embodiment of the present invention, the pixel 11 can have any structure as long as the gate voltage Vgs of the transistor 15 can be held in the capacitor 18 or the gate capacitance of the transistor 15 in the case where the capacitor 18 is not included. Electric charge accumulated in the capacitor 18 is released by drain current flowing to the transistor 15 and thus the threshold voltage of the transistor 15 may be held in the capacitor 18. In one embodiment of the present invention, the pixel 11 may be configured to control the extraction of drain current flowing through the transistor 15 by the switch 17. The pixel 11 may thus include not only the transistor 15, the switches 16 and 17, and the capacitor 18 but a circuit component such as a transistor, a capacitor, a resistor, or an inductor. A different circuit component may be thus provided among the transistor 15, the switches 16 and 17, the capacitor 18, and the wiring 19 so as to achieve the above structure.

The monitor circuit 12 has a function of generating a signal containing information on the value of the drain current of the transistor 15 using the drain current extracted from the pixel 11 through the switch 17. For example, a current-voltage converter circuit such as an integrator circuit can be used as the monitor circuit 12. The drain current of the transistor 15 contains information relevant to the mobility and the size (channel width and channel length) of the transistor 15.

The image processing circuit 13 has a function of correcting an image signal which is input to the pixel 11, in accordance with the signal generated by the monitor circuit 12. Specifically, in the case where it is determined from the signal generated by the monitor circuit 12 that the value of the drain current of the transistor 15 is larger than a desired value, the image processing circuit 13 corrects the image signal so as to decrease the drain current of the transistor 15. Conversely, in the case where it is determined from the signal generated by the monitor circuit 12 that the value of the drain current of the transistor 15 is smaller than the desired value, the image processing circuit 13 corrects the image signal so as to increase the drain current of the transistor 15.

The correction of the image signal makes it possible to correct not only variation in threshold voltages of the transistors 15 among pixels 11 but also variation in other electrical characteristics, such as mobility, of the transistor 15. Thus, variation in luminance of the light-emitting elements 14 among pixels 11 can be further suppressed as compared with the case where threshold voltage correction is performed inside the pixels 11.

Even in the case where threshold voltage correction inside the pixel 11 (hereinafter referred to as internal correction) is not performed and image signal correction by the image processing circuit 13 (hereinafter referred to as external correction) is performed, it is possible to correct not only variation in threshold voltages of the transistors 15 among the pixels 11 but also variation in electrical characteristics other than threshold voltage, such as mobility, of the transistor 15. However, in the case where the internal correction is not performed and only external correction is performed, the amplitude of image signal potential needs to be further increased than the case where neither correction is performed.

Figure 3:
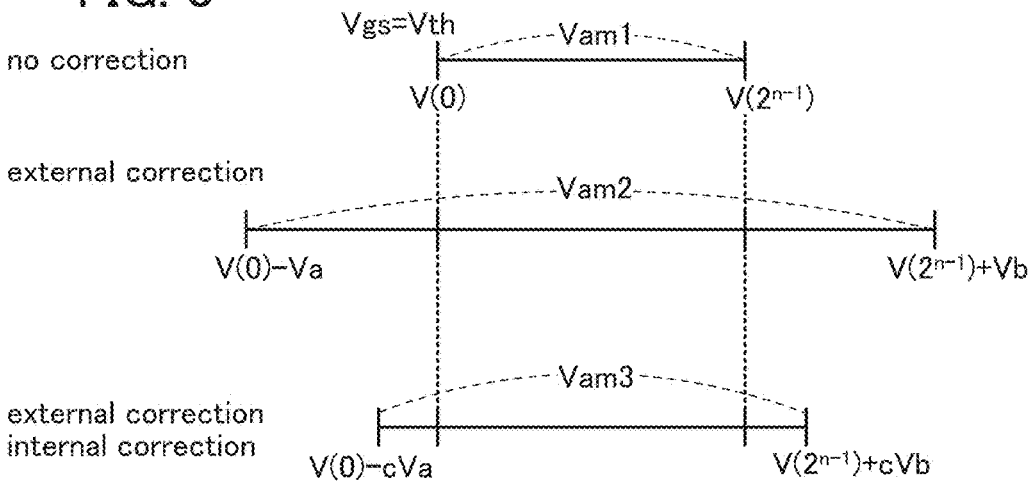
FIG. 3 schematically illustrates amplitudes of potentials of image signals.

FIG. 3 schematically shows an amplitude Vam1 of an image signal potential where neither correction is performed, and an amplitude Vam2 of an image signal potential where external correction is performed but internal correction is not performed. Note that the total number of grayscales is $2^n$.

As shown in FIG. 3, the amplitude Vam1 (no correction) is equivalent to the potential difference between a potential V(0) of an image signal corresponding to the lowest grayscale level 0 and a potential $V(2^{n-1})$ of an image signal corresponding to the highest grayscale level $2^{n-1}$. In the case where external correction is performed and internal correction is not performed, an image signal corresponding to the lowest grayscale level 0 has a potential V(0)−Va when a negative shift of threshold voltage or a positive shift of mobility in the transistor 15 are taken into consideration. An image signal corresponding to the highest grayscale level $2^{n-1}$ has a potential $V(2^{n-1})$+Vb when a positive shift of threshold voltage or a negative shift of mobility in the transistor 15 are taken into consideration. The amplitude Vam2 is thus equivalent to the potential difference between the potential V(0)−Va and the potential $V(2^{n-1})$+Vb.

The amplitude Vam2 of an image signal potential where external correction is performed and internal correction is not performed is larger than the amplitude Vam1 of an image signal potential where neither correction is performed. When the amplitude Vam2 is increased, potential differences between image signals in different grayscale levels are accordingly increased; thus, when the amplitude Vam2 is too large, it is difficult to express smooth gradations of an image with luminance differences and image quality is likely to be decreased. The decrease in image quality can be prevented by increasing the total number of grayscales and decreasing potential differences between image signals in different grayscale levels. However, time and power for transferring image signals or processing other signals is accordingly increased in the image processing circuit 13, a controller, an image memory, and the like that process digital image signals. The total number of grayscales of n bits can be only increased by at most 2 bits when high speed operation and low power consumption in the image processing circuit 13, the controller, and the image memory are taken into consideration. It is thus difficult to prevent degradation in image quality when the amplitude Vam2 is large.

In one embodiment of the present invention, not only external correction but internal correction is performed. An amplitude Vam3 of an image signal potential in the embodiment is schematically illustrated in FIG. 3. In the case where external correction and internal correction are both performed, a negative shift or a positive shift of the threshold voltage is corrected by the internal correction. Thus, external correction may be performed to correct variation in electrical characteristics other than threshold voltage, such as mobility, of the transistor 15. Specifically, as shown in FIG. 3, an image signal corresponding to the lowest grayscale level 0 has a potential V(0)−cVa when a positive shift of mobility in the transistor 15 is taken into consideration. Note that c is a constant determined by internal correction of threshold voltage and a positive number of 1 or smaller, such as 0.1 to 0.3. An image signal corresponding to the highest grayscale level 2 has a potential $V(2^{n-1})$+cVb when a negative shift of mobility in the transistor 15 is taken into consideration. The amplitude Vam3 is thus equivalent to the potential difference between the potential V(0)−cVa and the potential $V(2^{n-1})$+cVb. This potential difference is larger than the amplitude Vam1 and smaller than the amplitude Vam2.

In one embodiment of the present invention, external correction and internal correction are combined to reduce the amplitude of a potential of an image signal as compared to the case where only external correction is performed and internal correction is not performed. Luminance unevenness of images due to variation in electrical characteristics of the transistor 15 can be thus corrected and potential differences between image signals in different grayscale levels can be reduced to suppress degradation in image quality. Moreover, in one embodiment of the present invention, by combination of external correction and internal correction, electrical characteristics other than threshold voltage, such as mobility, can also be corrected, which cannot be achieved only by internal correction.

Note that external correction is not necessarily performed in each image rewriting. For example, external correction may be performed only in a predetermined period.

One embodiment of the present invention may include a period where external correction and internal correction are both performed, a period where either external correction or internal correction is performed, and a period where neither correction is performed.

<Specific Structural Example of Light-Emitting Device>

Figure 2:
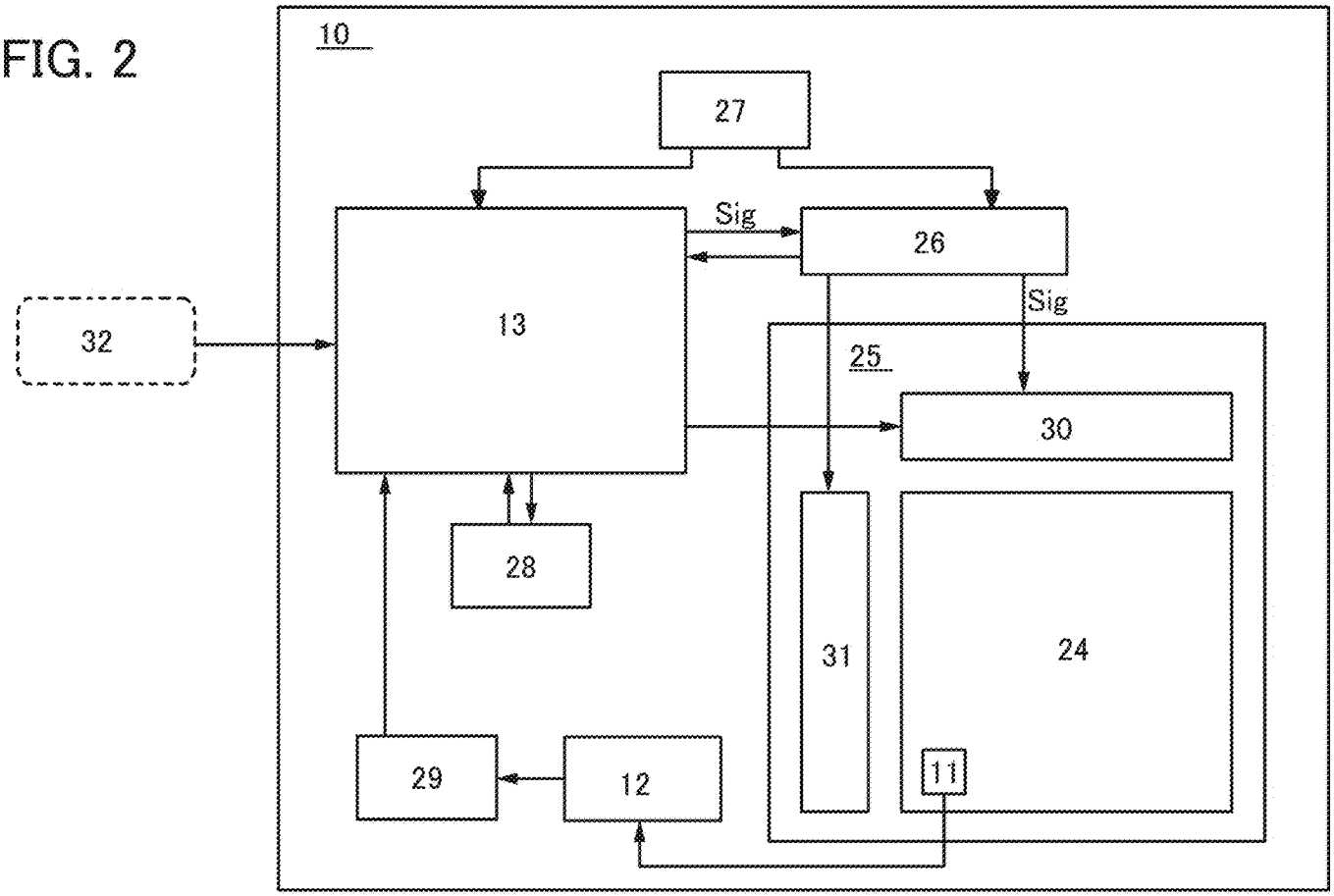
FIG. 2 illustrates a specific structure of a light-emitting device.

A structure example of the light-emitting device 10 illustrated in FIG. 1 is described in detail. FIG. 2 is a block diagram illustrating a structural example of the light-emitting device 10 of one embodiment of the present invention. Although the block diagram shows elements classified according to their functions in independent blocks, it may be practically difficult to completely separate the elements according to their functions and, in some cases, one element may be involved in a plurality of functions.

The light-emitting device 10 illustrated in FIG. 2 includes a panel 25 including a plurality of pixels 11 in a pixel portion 24, a controller 26, a CPU 27, the image processing circuit 13, an image memory 28, a memory 29, and the monitor circuit 12. In addition, the light-emitting device 10 illustrated in FIG. 2 includes a driver circuit 30 and a driver circuit 31 in the panel 25.

The CPU 27 has a function of decoding an instruction input from the outside or an instruction stored in a memory provided in the CPU 27 and executing the instruction by controlling the overall operations of various circuits included in the light-emitting device 10.

The monitor circuit 12 generates a signal containing information on a drain current value from the drain current output from the pixel 11. The memory 29 stores the information contained in the signal. Note that a volatile memory such as a DRAM or an SRAM; or a nonvolatile memory such as a flash memory, an MRAM, a magnetic memory, a magnetic disk, or a magneto-optical disk can be used as the memory 29. For example, when a nonvolatile memory is used as the memory 29, information of the pixels can be stored even after the power supply is stopped; thus, drain current is not necessarily always output from the pixel 11. The operation of outputting drain current from the pixel 11 is performed only before shipment of products, only immediately before stopping power supply, only immediately after starting power supply, or the like to store the information in the memory 29.

The image memory 28 has a function of storing image data 32 which is input to the light-emitting device 10. Note that although only one image memory 28 is provided in the light-emitting device 10 in FIG. 2, a plurality of image memories 28 may be provided in the light-emitting device 10. For example, in the case where the pixel portion 24 displays a full-color image with the use of three pieces of image data 32 corresponding to hues such as red, blue, and green, respective image memories 28 corresponding to the pieces of image data 32 may be provided.

As the image memory 28, for example, a memory circuit such as a dynamic random access memory (DRAM) or a static random access memory (SRAM) can be used. Alternatively, a video RAM (VRAM) may be used as the image memory 28.

The image processing circuit 13 has a function of writing and reading the image data 32 to and from the image memory 28 in response to an instruction from the CPU 27 and generating an image signal Sig from the image data 32. In addition, the image processing circuit 13 has a function of reading the information stored in the memory 29 in response to an instruction from the CPU 27 and correcting the image signal using the information.

The controller 26 has a function of processing the image signal Sig which includes image information and is input to the controller 26, in accordance with the specification of the panel 25 and then supplying the processed image signal Sig to the panel 25.

The driver circuit 31 has a function of selecting a plurality of pixels 11 included in the pixel portion 24 row by row. The driver circuit 30 has a function of supplying the image signal Sig supplied from the controller 26 to the pixels 11 in a row selected by the driver circuit 31.

Note that the controller 26 has a function of supplying various driving signals used for driving the driver circuit 30, the driver circuit 31, and the like to the panel 25. The driving signals include a start pulse signal SSP and a clock signal SCK which control the operation of the driver circuit 30, a latch signal LP, a start pulse signal GSP and a clock signal GCK which control the operation of the driver circuit 31, and the like.

Note that the light-emitting device 10 may include an input device having a function of supplying information or an instruction to the CPU 27 included in the light-emitting device 10. As the input device, a keyboard, a pointing device, a touch panel, a sensor, or the like can be used.

<Configuration Example 1 of Pixel>

Next, a specific configuration example of the pixel 11 included in the light-emitting device 10 illustrated in FIG. 1 is described.

Figure 4:
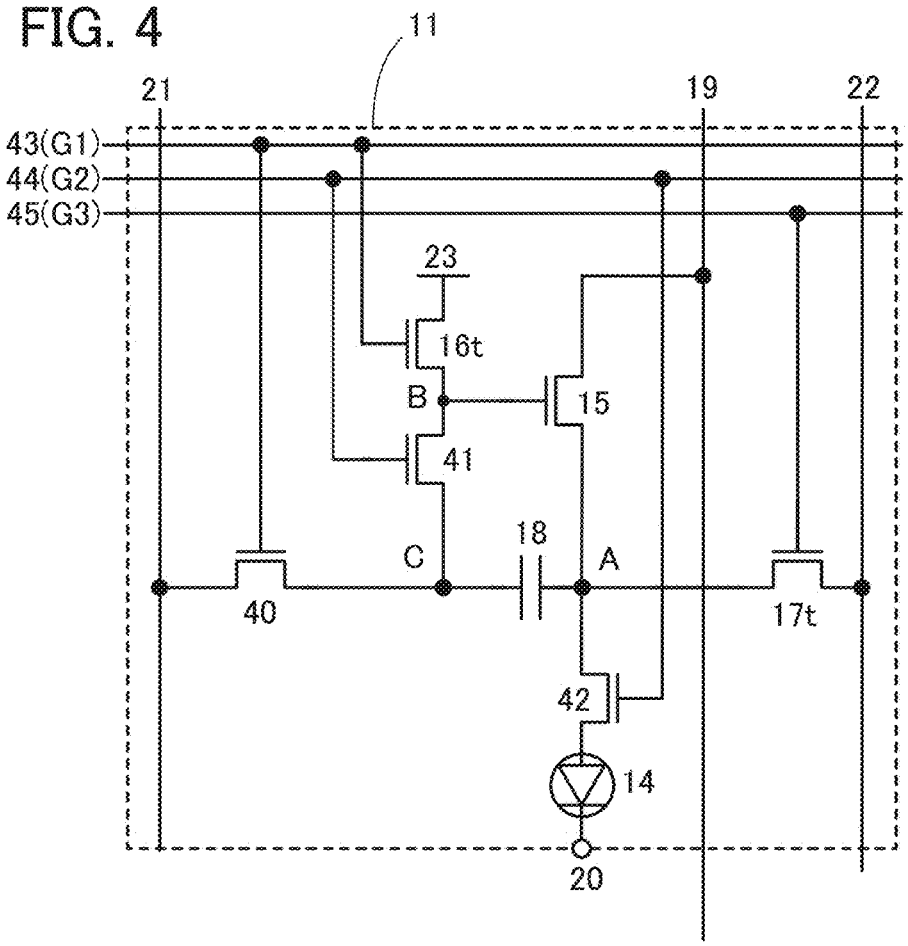
FIG. 4 illustrates a structure of a pixel.

FIG. 4 illustrates an example of a circuit diagram of the pixel 11. The pixel 11 includes the transistor 15, a transistor 16*t* serving as the switch 16, a transistor 17*t* serving as the switch 17, the capacitor 18, the light-emitting element 14, and transistors 40, 41, and 42.

The potential of a pixel electrode of the light-emitting element 14 is controlled by the image signal Sig which is input to the pixel 11. The luminance of the light-emitting element 14 is determined by a potential difference between the pixel electrode and a common electrode. For example, in the case where an OLED is used as the light-emitting element 14, one of the anode and the cathode serves as the pixel electrode and the other thereof serves as the common electrode. FIG. 4 illustrates a configuration of the pixel 11 in which the anode of the light-emitting element 14 is used as the pixel electrode and the cathode of the light-emitting element 14 is used as the common electrode.

The transistor 40 has a function of controlling conduction between the wiring 21 and one electrode of the capacitor 18. The other electrode of the capacitor 18 is connected to one of a source and a drain of the transistor 15. The transistor 16*t* has a function of controlling conduction between the wiring 23 and the gate of the transistor 15. The transistor 41 has a function of controlling conduction between one electrode of the capacitor 18 and the gate of the transistor 15. The transistor 42 has a function of controlling conduction between one of the source and the drain of the transistor 15 and the anode of the light-emitting element 14. The transistor 17*t* has a function of controlling conduction between one of the source and the drain of the transistor 15 and the wiring 22.

In FIG. 4, the other of the source and the drain of the transistor 15 is connected to the wiring 19.

The transistor 40 is turned on and off in accordance with the potential of the wiring 43 which is connected to a gate of the transistor 40. The transistor 16*t* is turned on and off in accordance with the potential of the wiring 43 which is connected to a gate of the transistor 16*t*. The transistor 41 is turned on and off in accordance with the potential of the wiring 44 which is connected to a gate of the transistor 41. The transistor 42 is turned on and off in accordance with the potential of the wiring 44 which is connected to a gate of the transistor 42. The transistor 17*t* is turned on and off in accordance with the potential of the wiring 45 which is connected to a gate of the transistor 17*t*.

In the transistors included in the pixel 11, an oxide semiconductor or an amorphous, microcrystalline, polycrystalline, or single crystal semiconductor can be used. As a material of such a semiconductor, silicon, germanium, or the like can be given. When the transistors 40, 16*t*, and 41 include oxide semiconductors in channel formation regions, the off-state current of the transistors 40, 16*t*, and 41 can be extremely low. Furthermore, when the transistors 40, 16*t*, and 41 having the above-described structure are used in the pixels 11, leakage of electric charge accumulated in the gate of the transistor 15 can be prevented effectively as compared with the case where a transistor including a normal semiconductor such as silicon or germanium is used as the transistors 40, 16*t*, and 41.

Accordingly, for example, in the case where image signals Sig each having the same image information are written to the pixel portion for some consecutive frame periods as in the case of displaying a still image, display of an image can be maintained even when driving frequency is low, in other words, the number of operations of writing image signals Sig to the pixel portion for a certain period is reduced. For example, by using a highly purified oxide semiconductor for semiconductor films of the transistors 40, 16*t*, and 41, the interval between the operations of writing image signals Sig can be 10 seconds or longer, preferably 30 seconds or longer, more preferably 1 minute or longer. As the interval between the operations of writing image signals Sig increases, power consumption can be further reduced.

In addition, since the potential of the image signal Sig can be held for a longer period, the quality of an image to be displayed can be prevented from being lowered even when the capacitor 18 for holding the potential of the gate of the transistor 15 is not provided in the pixel 11. Thus, it is possible to increase the aperture ratio of the pixel 11 by reducing the size of the capacitor 18 or without providing the capacitor 18. Accordingly, the light-emitting element 14 with long lifetime can be obtained, whereby the reliability of the light-emitting device 10 can be increased.

Note that in FIG. 4, the pixel 11 may further include another circuit element such as a transistor, a diode, a resistor, a capacitor, or an inductor as needed.

In FIG. 4, the transistors each have the gate on at least one side of a semiconductor film; alternatively, the transistors may each have a pair of gates with a semiconductor film positioned therebetween. When one gate is regarded as a back gate, potentials at the same level may be applied to a normal gate and the back gate, or a fixed potential such as a ground potential may be applied only to the back gate. By controlling the level of the potential applied to the back gate, the threshold voltage of the transistor can be controlled. By providing the back gate, a channel formation region is enlarged and the drain current can be increased. Moreover, providing the back gate facilitates formation of a depletion layer in the semiconductor film, which results in lower subthreshold swing.

The transistors in FIG. 4 are all n-channel transistors. When the transistors in the pixel 11 have the same channel type, it is possible to omit some of steps for fabricating the transistors, for example, a step of adding an impurity element imparting one conductivity type to the semiconductor film. Note that in the light-emitting device according to one embodiment of the present invention, not all the transistors in the pixel 11 are necessarily n-channel transistors. In the case where the cathode of the light-emitting element 14 is connected to the wiring 20, it is preferable that at least the transistor 15 be an n-channel transistor. In the case where the anode of the light-emitting element 14 is connected to the wiring 20, it is preferable that at least the transistor 15 be a p-channel transistor.

FIG. 4 illustrates the case where the transistors in the pixel 11 have a single-gate structure including one gate and one channel formation region; however, one embodiment of the present invention is not limited to this structure. Any or all of the transistors in the pixel 11 may have a multi-gate structure including a plurality of gates electrically connected to each other and a plurality of channel formation regions.

Figure 5:
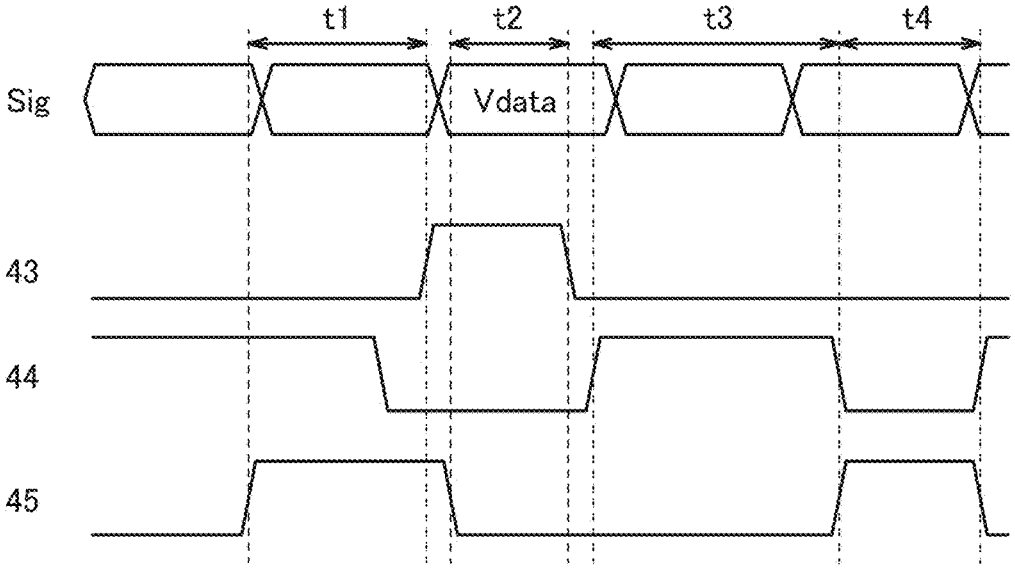
FIG. 5 is a timing chart of the pixel.
Figure 6A:
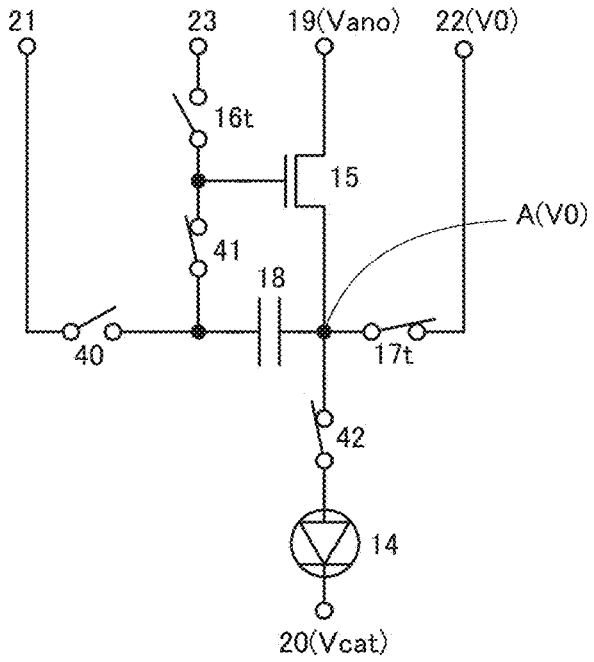
FIGS. 6A and 6B schematically illustrate the operation of the pixel.
Figure 6B:
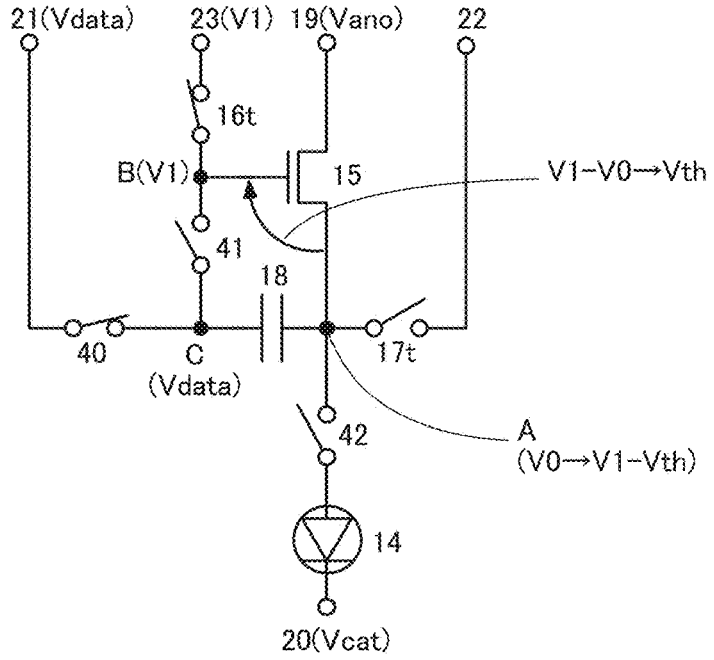
Figure 7A:
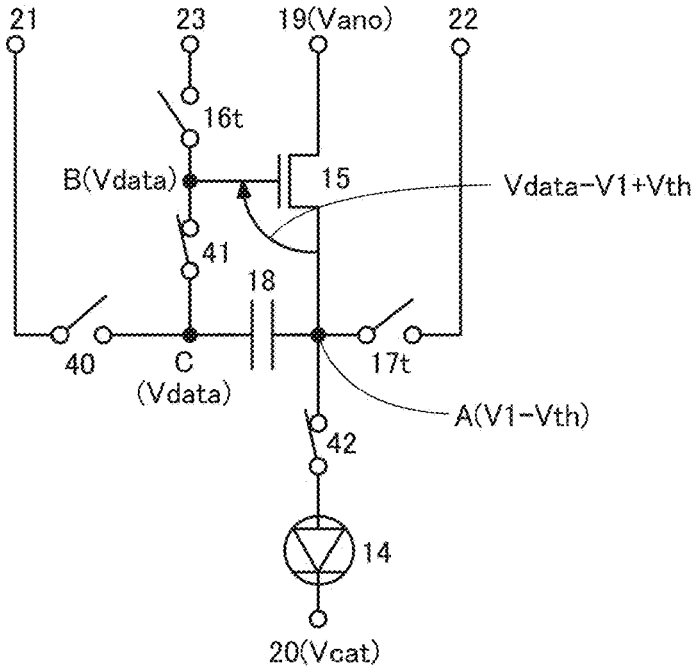
FIGS. 7A and 7B schematically illustrate the operation of the pixel.
Figure 7B:
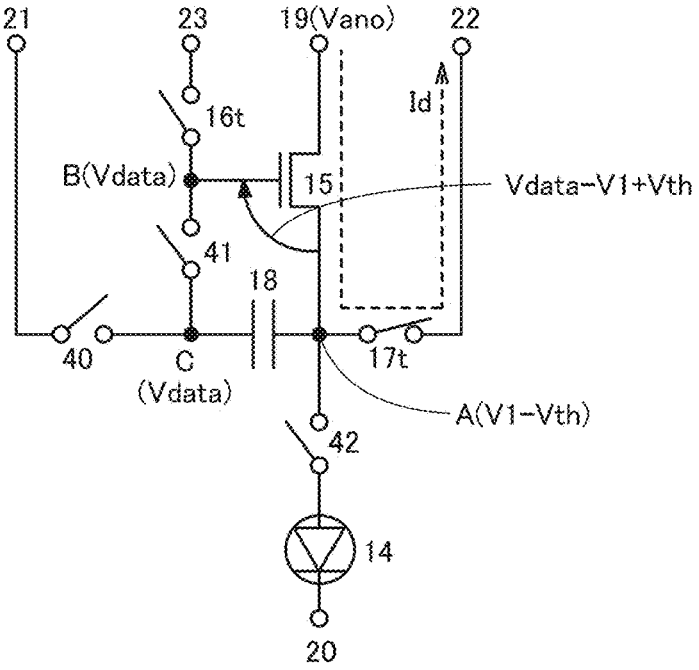

FIG. 5 is a tuning chart of potentials of the wirings 43, 44, and 45 which are connected to the pixel 11 as shown in FIG. 4, and a potential of the image signal Sig which is supplied to the wiring 21. Note that the timing chart of FIG. 5 is an example in which all the transistors included in the pixel 11 shown in FIG. 4 are n-channel transistors. FIGS. 6A and 6B and FIGS. 7A and 7B schematically illustrate the operation of the pixel 11 in periods t1, t2, t3, and t4, respectively. Note that to simplify the operation of the pixel 11, transistors other than the transistor 15 is illustrated as switches in FIGS. 6A and 6B and FIGS. 7A and 7B.

In the period t1, a low-level potential is applied to the wiring 43 and a high-level potential is applied to the wirings 44 and 45. The transistors 41, 42, and 17*t* are thus turned on and the transistors 40 and 16*t* are turned off as in FIG. 6A. The transistors 42 and 17*t* are turned on, whereby a potential V0, which is the potential of the wiring 22, is applied to the one of the source and the drain of the transistor 15 and the other electrode of the capacitor 18 (represented as a node A).

Furthermore, a potential Vano and a potential Vcat are applied to the wiring 19 and the wiring 20, respectively. The potential Vano is preferably higher than the sum of the potential V0 and the threshold voltage Vthe of the light-emitting element 14. The potential V0 is preferably lower than the sum of the potential Vcat and the threshold voltage Vthe of the light-emitting element 14. With the potential V0 set in the range, current can be prevented from flowing through the light-emitting element 14 in the period t1.

A low-level potential is then applied to the wiring 44, and the transistors 41 and 42 are accordingly turned off and the node A is held at the potential V0.

In the next period t2, a high-level potential, a low-level potential, and a low-level potential are applied to the wiring 43, the wiring 44, and the wiring 45, respectively. The transistors 40 and 16*t* are accordingly turned on and the transistors 41, 42, and 17*t* are turned off as in FIG. 6B.

Note that it is preferable in the transition from the period t1 to the period t2 that the potential applied to the wiring 43 be changed from low to high and then the potential applied to the wiring 45 be changed from high to low. This operation prevents change in the potential of the node A due to the change of the potential applied to the wiring 43.

The potential Vano is applied to the wiring 19, and the potential Vcat is applied to the wiring 20. The potential Vdata of the image signal Sig is applied to the wiring 21, and the potential V1 is applied to the wiring 23. Note that the potential V1 is preferably higher than the sum of the potential Vcat and the threshold voltage Vth of the transistor 15 and lower than the sum of the potential Vano and the threshold voltage Vth of the transistor 15.

Note that in the pixel structure shown in FIG. 4, even if the potential V1 is higher than the sum of the potential Vcat and the threshold voltage Vthe of the light-emitting element 14, the light-emitting element 14 does not emit light as long as the transistor 42 is off. The allowable potential V0 range can be thus expanded and the allowable range of V1-V0 can also be increased. As a result of increasing the degree of freedom of values for V1-V0, threshold voltage of a transistor 15 can be accurately obtained even when time required to obtain the threshold voltage of the transistor 15 is reduced or is limited.

By this operation, the potential V1 which is higher than the sum of the potential of the node A and the threshold voltage is input to the gate of the transistor 15 (represented as a node B), and the transistor 15 is turned on. Charge in the capacitor 18 is then discharged through the transistor 15, and the potential of the node A, which is the potential V0, starts to rise. The potential of the node A finally converges to the potential V1−Vth and the gate voltage of the transistor 15 converges to the threshold voltage Vth of the transistor 15; then, the transistor 15 is turned off.

The potential Vdata of the image signal Sig applied to the wiring 21 is applied to the one electrode of the capacitor 18 (represented as a node C) through the transistor 40.

In the next period t3, a low-level potential, a high-level potential, and a low-level potential are applied to the wiring 43, the wiring 44, and the wiring 45, respectively. The transistors 41 and 42 are accordingly turned on and the transistors 40, 16*t*, and 17*t* are turned off as in FIG. 7A.

During transition from the period t2 to t3, it is preferable that the potential applied to the wiring 43 be changed from high to low, and then, the potential applied to the wiring 44 be changed from low to high. This structure can prevent potential change of the node A due to change of the potential applied to the wiring 43.

The potential Vano and the potential Vcat are applied to the wiring 19 and the wiring 20, respectively.

The potential Vdata is applied to the node B by the above operation, and the gate voltage of the transistor 15 becomes Vdata−V1+Vth. The gate voltage of the transistor 15 can be the value to which the threshold voltage Vth is added. With this structure, variation of the threshold voltages Vth of the transistor 15 can be reduced. Thus, variation of current values supplied to the light-emitting element 14 can be suppressed, whereby reducing unevenness in luminance of the light-emitting device.

Note that the potential applied to the wiring 44 is greatly varied here, whereby an influence of variation of threshold voltages of the transistor 42 on the value of a current supplied to the light-emitting element 14 can be prevented. In other words, the high-level potential applied to the wiring 44 is much higher than the threshold voltage of the transistor 42, and the low-level potential applied to the wiring 44 is much lower than the threshold voltage of the transistor 42 to secure switching of the transistor 42, so that the influence of variation of threshold voltages of the transistor 42 on the value of current supplied to the light-emitting element 14 can be prevented.

In the next period t4, a low-level potential, a low-level potential, and a high-level potential are applied to the wiring 43, the wiring 44, and the wiring 45, respectively. The transistor 17*t* is accordingly turned on and the transistors 16*t*, 40, 41, and 42 are turned off as in FIG. 7B.

In addition, the potential Nano is applied to the wiring 19 and the monitor circuit is connected to the wiring 22.

By the above operation, a drain current Id of the transistor 15 flows into not the light-emitting element 14 but the wiring 22 through the transistor 17*t*. The monitor circuit generates a signal including information about the value of the drain current Id by using the drain current Id flowing through the wiring 22. The magnitude of the drain current Id depends on the mobility or the size (channel length, channel width) of the transistor 15. Using the above signal, the light-emitting device according to one embodiment of the present invention can thus correct the value of the potential Vdata of the image signal VSig supplied to the pixel 11. That is, the influence of variation in mobility of the transistor 15 can be reduced.

Note that in the light-emitting device including the pixel 11 illustrated in FIG. 4, the operation in the period t4 is not necessarily always performed after the operation in the period t3. For example, in the light-emitting device, the operation in the period t4 may be performed after the operations in the periods t1 to t3 are repeated a plurality of times. Alternatively, after the operation in the period t4 is performed on pixels 11 in one row, the light-emitting elements 14 may be brought into a non-light-emitting state by writing an image signal corresponding to the lowest gray-scale level 0 to the pixels 11 in the row which have been subjected to the above operation. Then, the operation in the period t4 may be performed on pixels 11 in the next row.

In the light-emitting device which includes the pixel 11 illustrated in FIG. 4, the other of the source and the drain of the transistor 15 is electrically separated from the gate of the transistor 15, so that their potentials can be individually controlled. The potential of the other of the source and the drain of the transistor 15 can be thus set higher than a value that is the sum of the potential of the gate of the transistor 15 and the threshold voltage Vth, in the period t2. When the transistor 15 is a normally-on transistor, that is, when the threshold voltage Vth is negative, charge can be accumulated in the capacitor 18 until the potential of the source of the transistor 15 becomes higher than the potential V1 of the gate of the transistor 15. For these reasons, in the light-emitting device according to one embodiment of the present invention, even when the transistor 15 is a normally on transistor, the threshold voltage can be obtained in the period t2; and in the period t3, the gate voltage of the transistor 15 can be set to a value obtained by adding the threshold voltage Vth.

As a result, in the light-emitting device according to one embodiment of the present invention, display unevenness can be reduced and high-quality images can be displayed even if the transistor 15 including a semiconductor film containing an oxide semiconductor, for example, becomes normally on.

Figure 20:
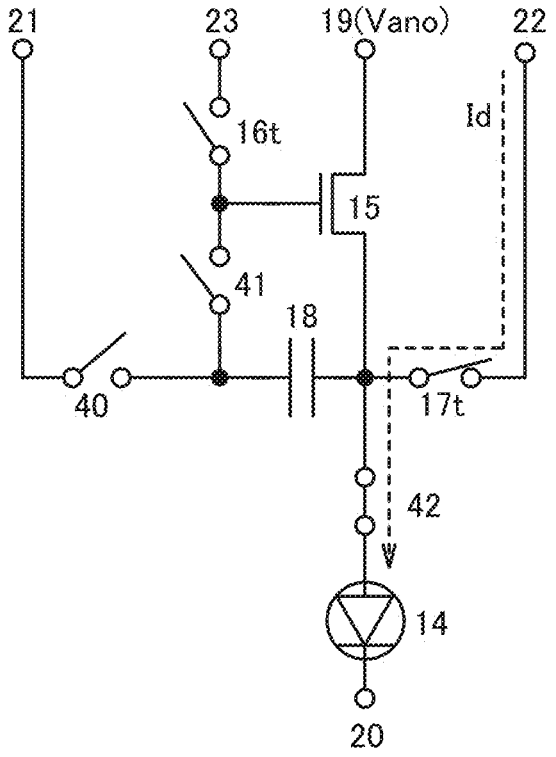
FIG. 20 schematically illustrates the operation of the pixel.

Not only the characteristics of the transistor 15 but also the characteristics of the light-emitting element 14 may be monitored, and an example of the operation in that case is illustrated in FIG. 20. Here, it is preferable that current not flow through the transistor 15 by controlling the potential Vdata of the image signal Sig, for example. The current of the light-emitting element 14 can be thus extracted, and degradation or variation in current characteristics of the light-emitting element 14 can be obtained.

<Connection Structure of Pixel and Monitor Circuit>

Figure 19:
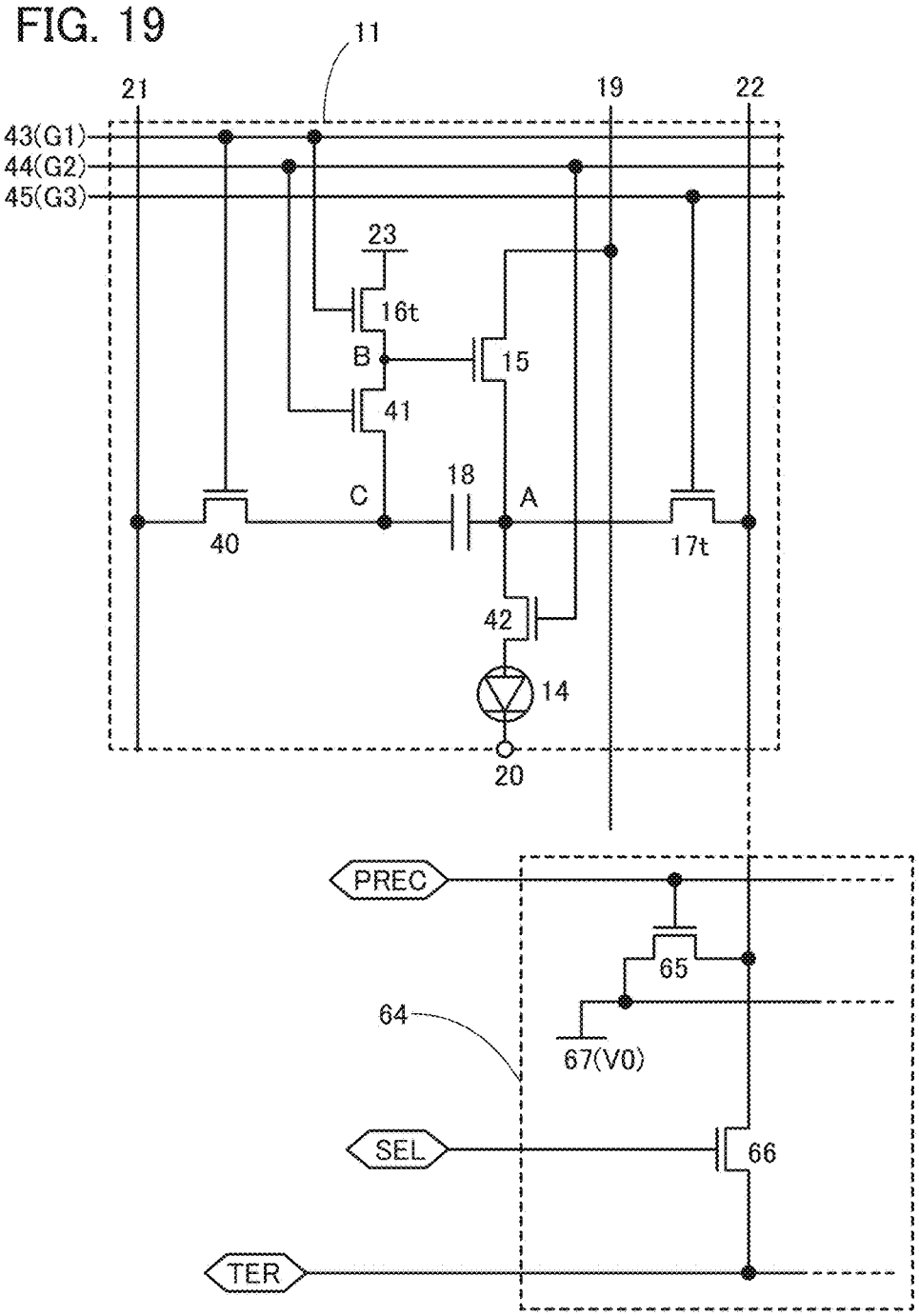
FIG. 19 illustrates a connection structure of a pixel and a selection circuit.

An example of connection structure of the pixel 11 illustrated in FIG. 4 and the monitor circuit will be described. FIG. 19 shows a selection circuit 64 as an example and the pixel 11 in FIG. 4.

The selection circuit 64 chooses either a wiring 67 to which the potential V0 is supplied or a terminal TER connected to the monitor circuit and electrically connects the chosen one to the wiring 22 in the pixel 11. Specifically, the selection circuit 64 in FIG. 19 includes a transistor 65 and a transistor 66. The transistor 65 is turned on and off in accordance with the potential of a wiring PREC which is connected to its gate. One of a source and a drain of the transistor 65 is connected to the wiring 67, and the other is connected to the wiring 22. The transistor 66 is turned on and off in accordance with the potential of a wiring SEL which is connected to its gate. One of a source and a drain of the transistor 66 is connected the wiring 22 and the other is connected to the terminal TER.

<Pixel Structure Example 2>

Next, another specific example of a structure of the pixel 11 included in the light-emitting device 10 shown in FIG. 1, which is different from FIG. 4, will be described.

Figure 8:
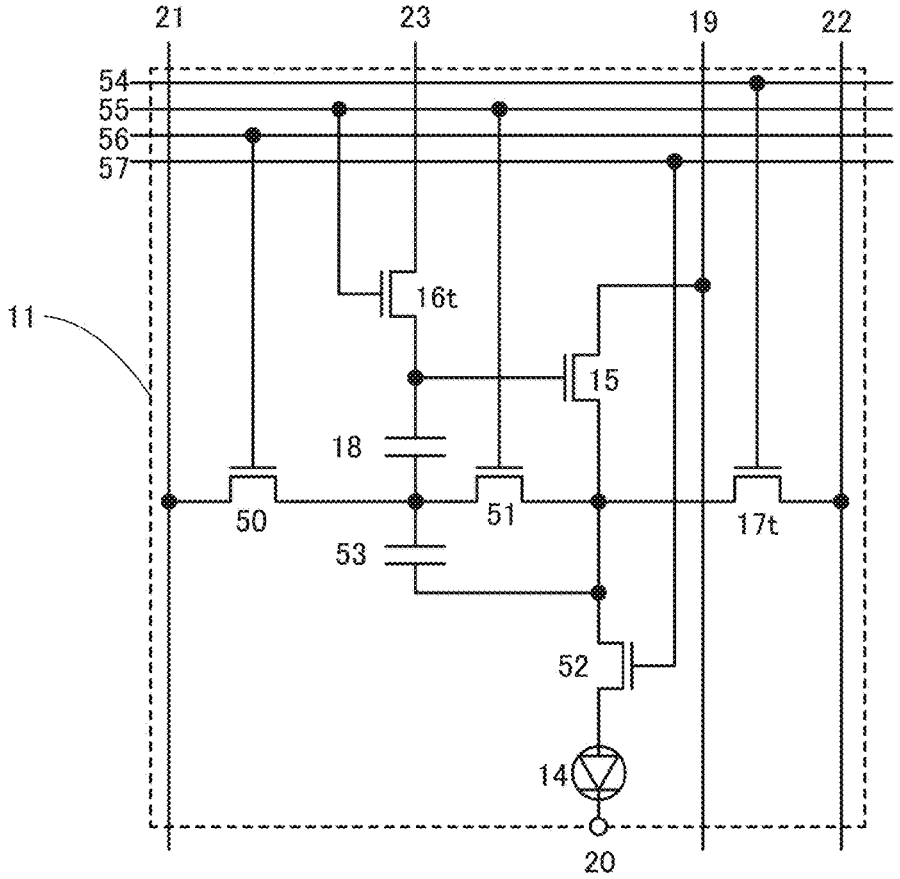
FIG. 8 illustrates a structure of a pixel.

FIG. 8 illustrates an example of a circuit diagram of the pixel 11. The pixel 11 includes the transistor 15, a transistor 16*t* serving as the switch 16, a transistor 17*t* serving as the switch 17, the capacitor 18, the light-emitting element 14, transistors 50, 51, and 52, and a capacitor 53.

The potential of a pixel electrode of the light-emitting element 14 is controlled by the image signal Sig which is input to the pixel 11. The luminance of the light-emitting element 14 is determined by a potential difference between the pixel electrode and a common electrode. For example, in the case where an OLED is used as the light-emitting element 14, one of the anode and the cathode serves as the pixel electrode and the other thereof serves as the common electrode. FIG. 8 illustrates a configuration of the pixel 11 in which the anode of the light-emitting element 14 is used as the pixel electrode and the cathode of the light-emitting element 14 is used as the common electrode.

The transistor 50 has a function of controlling conduction between the wiring 21 and the one electrode of the capacitor 18. The other electrode of the capacitor 18 is electrically connected to the gate of the transistor 15. The transistor 16*t* has a function of controlling conduction between the wiring 23 and the gate of the transistor 15. The transistor 51 has a function of controlling conduction between one electrode of the capacitor 18 and the gate of the transistor 15. The transistor 52 has a function of controlling conduction between one of the source and the drain of the transistor 15 and the anode of the light-emitting element 14. The transistor 17*t* has a function of controlling conduction between one of the source and the drain of the transistor 15 and the wiring 22. In FIG. 8, the other of the source and the drain of the transistor 15 is connected to the wiring 19. One electrode of the capacitor 53 is connected to the one electrode of the capacitor 18, and the other is connected to one of the source and the drain of the transistor 15.

The transistor 50 is turned on and off in accordance with the potential of the wiring 56 which is connected to a gate of the transistor 50. The transistor 16*t* is turned on and off in accordance with the potential of the wiring 55 which is connected to a gate of the transistor 16*t*. The transistor 51 is turned on and off in accordance with the potential of the wiring 55 which is connected to a gate of the transistor 51. The transistor 52 is turned on and off in accordance with the potential of the wiring 57 which is connected to a gate of the transistor 52. The transistor 17*t* is turned on and off in accordance with the potential of the wiring 54 which is connected to a gate of the transistor 17*t*.

In the transistors included in the pixel 11, an oxide semiconductor or an amorphous, microcrystalline, polycrystalline, or single crystal semiconductor can be used. As a material of such a semiconductor, silicon, germanium, or the like can be given. When the transistor 16*t* includes oxide semiconductors in channel formation regions, the off-state current of the transistor 16*t* can be extremely low. Furthermore, when the transistor 16*t* having the above-described structure are used in the pixels 11, leakage of electric charge accumulated in the gate of the transistor 15 can be prevented effectively as compared with the case where a transistor including a normal semiconductor such as silicon or germanium is used as the transistor 16*t*.

Accordingly, for example, in the case where image signals Sig each having the same image information are written to the pixel portion for some consecutive frame periods as in the case of displaying a still image, display of an image can be maintained even when driving frequency is low, in other words, the number of operations of writing image signals Sig to the pixel portion for a certain period is reduced. For example, by using a highly purified oxide semiconductor for semiconductor films of the transistors 50, the interval between the operations of writing image signals Sig can be 10 seconds or longer, preferably 30 seconds or longer, more preferably 1 minute or longer. As the interval between the operations of writing image signals Sig increases, power consumption can be further reduced.

In addition, since the potential of the image signal Sig can be held for a longer period, the quality of an image to be displayed can be prevented from being lowered even when the capacitor 18 for holding the potential of the gate of the transistor 15 is not provided in the pixel 11. Thus, it is possible to increase the aperture ratio of the pixel 11 by reducing the size of the capacitor 18 or without providing the capacitor 18. Accordingly, the light-emitting element 14 with long lifetime can be obtained, whereby the reliability of the light-emitting device 10 can be increased.

Note that in FIG. 8, the pixel 11 may further include another circuit element such as a transistor, a diode, a resistor, a capacitor, or an inductor as needed.

In FIG. 8, the transistors each have the gate on at least one side of a semiconductor film; alternatively, the transistors may each have a pair of gates with a semiconductor film positioned therebetween. When one gate is regarded as a back gate, potentials at the same level may be applied to a normal gate and the back gate, or a fixed potential such as a ground potential may be applied only to the back gate. By controlling the level of the potential applied to the back gate, the threshold voltage of the transistor can be controlled. By providing the back gate, a channel formation region is enlarged and the drain current can be increased. Moreover, providing the back gate facilitates formation of a depletion layer in the semiconductor film, which results in lower subthreshold swing.

The transistors in FIG. 8 are all n-channel transistors. When the transistors in the pixel 11 have the same channel type, it is possible to omit some of steps for fabricating the transistors, for example, a step of adding an impurity element imparting one conductivity type to the semiconductor film. Note that in the light-emitting device according to one embodiment of the present invention, not all the transistors in the pixel 11 are necessarily n-channel transistors. In the case where the cathode of the light-emitting element 14 is connected to the wiring 20, it is preferable that at least the transistor 15 be an n-channel transistor. In the case where the anode of the light-emitting element 14 is connected to the wiring 20, it is preferable that at least the transistor 15 be a p-channel transistor.

FIG. 8 illustrates the case where the transistors in the pixel 11 have a single-gate structure including one gate and one channel formation region; however, one embodiment of the present invention is not limited to this structure. Any or all of the transistors in the pixel 11 may have a multi-gate structure including a plurality of gates electrically connected to each other and a plurality of channel formation regions.

Figure 9:
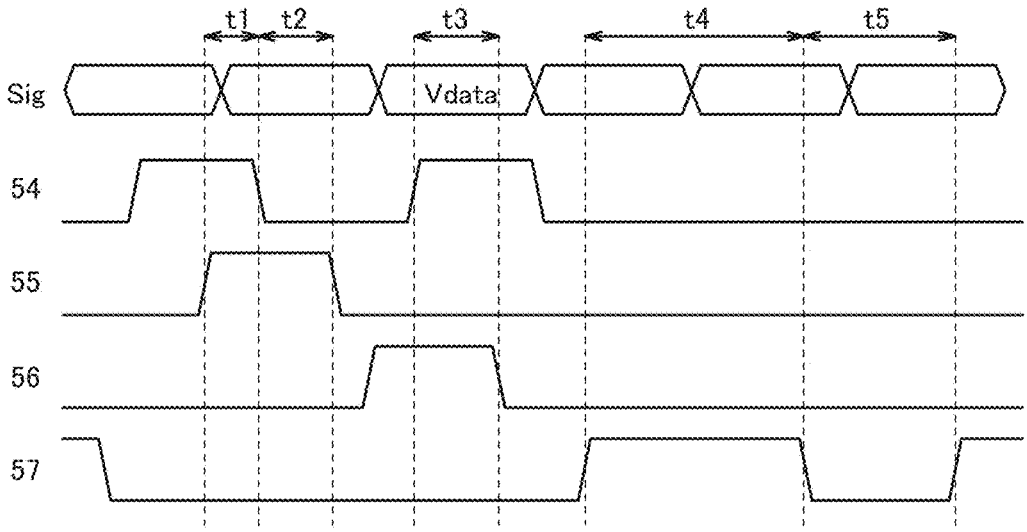
FIG. 9 is a timing chart of the pixel.

FIG. 9 is a timing chart of potentials of the wirings 54 to 57 which are connected to the pixel 11 as shown in FIG. 8, and a potential of the image signal Sig which is supplied to the wiring 21. Note that the timing chart of FIG. 9 is an example in which all the transistors included in the pixel 11 shown in FIG. 8 are n-channel transistors. FIGS. 10A and 10B and FIGS. 11A and 11B schematically illustrate the operation of the pixel 11 in periods t1, t2, t3, and t4, respectively. Note that to simplify the operation of the pixel 11, transistors other than the transistor 15 is illustrated as switches in FIGS. 10A and 10B and FIGS. 11A and 11B.

In the period t1, a high-level potential is applied to the wirings 54 and 55 and a low-level potential is applied to the wirings 56 and 57. The transistors 51, 16*t*, and 17*t* are thus turned on and the transistors 50 and 52 are turned off as in FIG. 10A. By this operation, a potential Vi2 of the wiring 23 is applied to the gate of the transistor 15, and a potential Vi1 of the wiring 22 is applied to one of the source and the drain of the transistor 15.

Note that the potential Vi1 is preferably lower than the sum of the the potential Vcat and the threshold voltage Vthe of the light-emitting element 14. Furthermore, the potential Vi2 is preferably higher than the sum of the potential Vi1 and the threshold voltage Vth of the transistor 15. As a result, the gate voltage of the transistor 15 is Vi2−Vi1 and the transistor 15 is turned on.

The potential Vi1 and the potential Vcat are applied to the wiring 19 and the wiring 20, respectively.

Figure 10A:
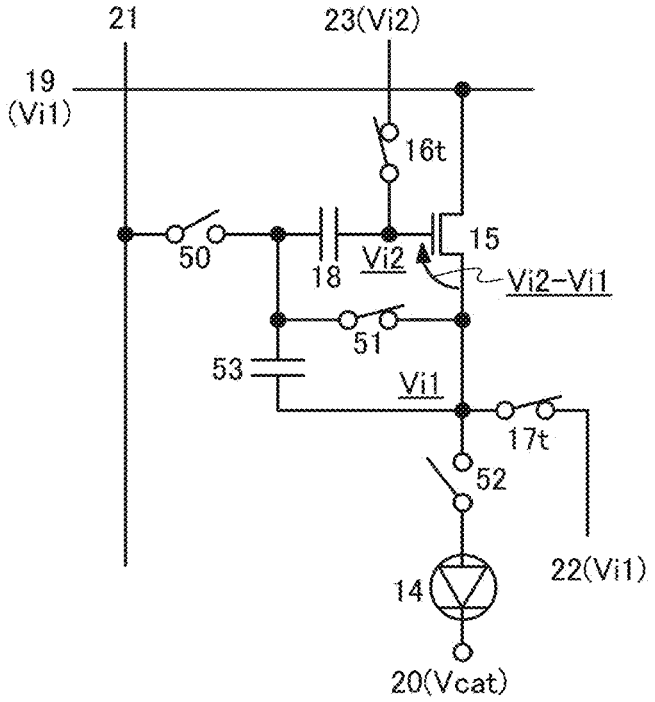
FIGS. 10A and 10B schematically illustrate the operation of the pixel.
Figure 10B:
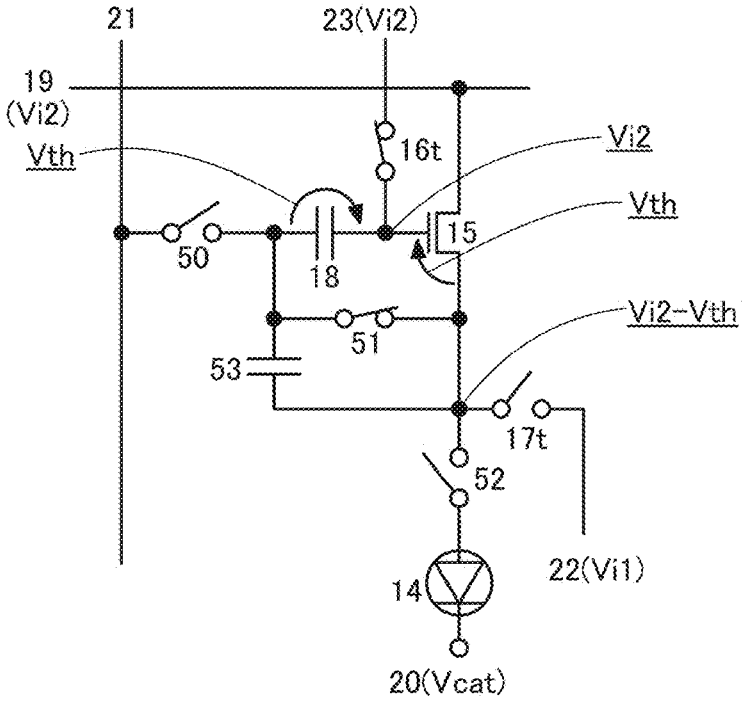
Figure 11A:
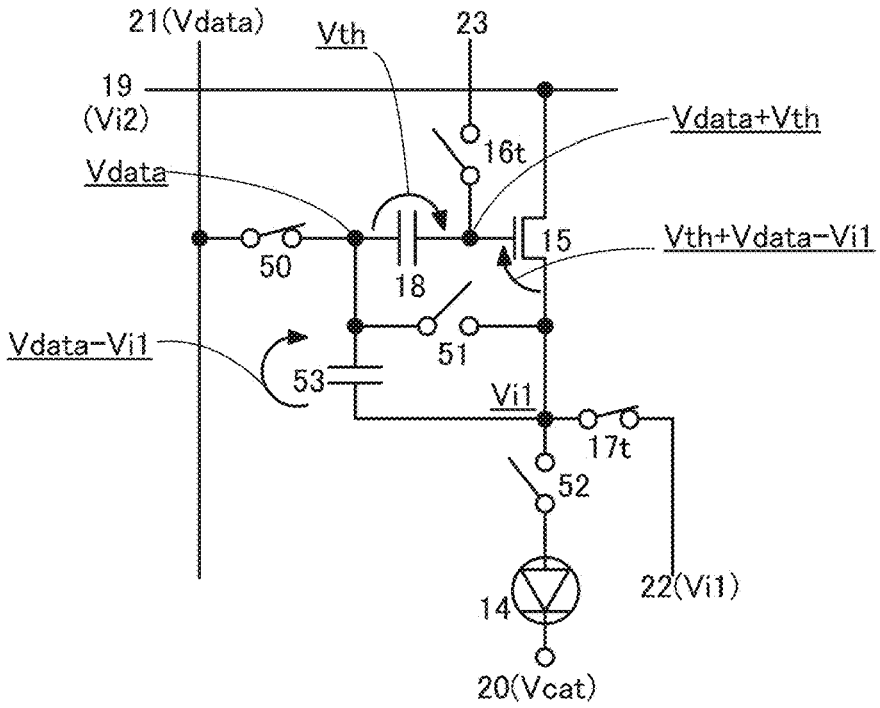
FIGS. 11A and 11B schematically illustrate the operation of the pixel.
Figure 11B:
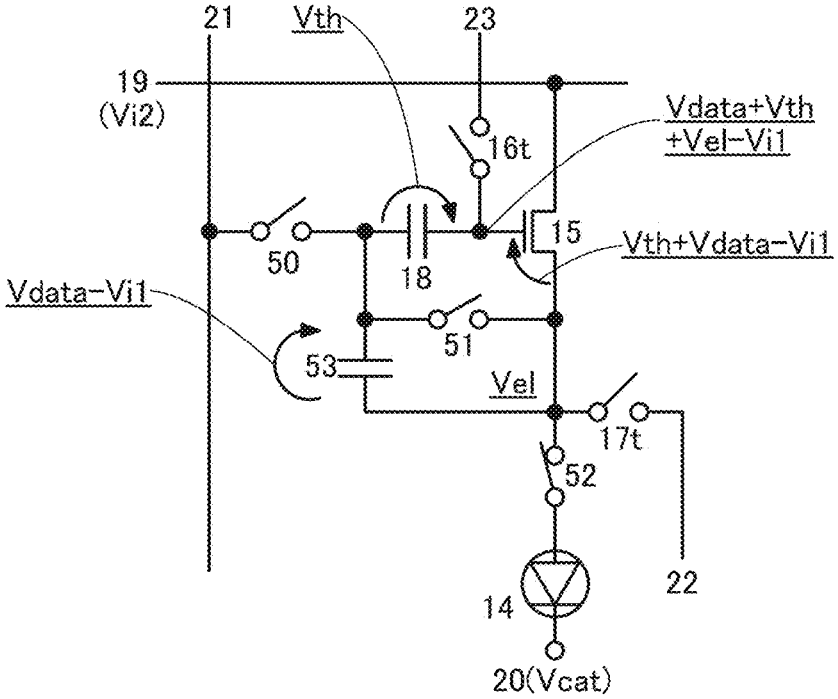

In the period t2, a low-level potential is applied to the wiring 54, a high-level potential is applied to the wiring 55, a low-level potential is applied to the wiring 56, and a low-level potential is applied to the wiring 57, and the transistors 16*t* and 51 remain on and the transistors 50, 52, and 17*t* remain off as shown in FIG. 10B. By this operation, the potential Vi2 is held by the gate of the transistor 15. Furthermore, the potential Vi2 and the potential Vcat are applied to the wiring 19 and the wiring 20, respectively.

Electric charge in the capacitor 18 is thus discharged through the transistor 15 which is on, and the potential of the source or the drain of the transistor 15, which is the potential Vi1, starts to rise. The potential of the source or the drain of the transistor 15 finally converges to the potential Vi2−Vth and the gate voltage of the transistor 15 converges to the threshold voltage Vth of the transistor 15; then, the transistor 15 is turned off. Then, the potential of the source or the drain of the transistor 15 converges Note that in the pixel structure shown in FIG. 8, even if the potential Vi2 is higher than the sum of the potential Vcat and the threshold voltage Vthe of the light-emitting element 14, the light-emitting element 14 does not emit light as long as the transistor 52 is off. The allowable potential Vi1 range can be thus expanded and the allowable range of Vi2−Vi1 can also be increased. As a result of increasing the degree of freedom of values for Vi2−Vi1, threshold voltage of a transistor 15 can be accurately obtained even when time required to obtain the threshold voltage of the transistor 15 is reduced or is limited.

In the following period t3, a high-level potential is applied to the wiring 54, a low-level potential is applied to the wiring 55, a high-level potential is applied to the wiring 57, and a low-level potential is applied to the wiring 57. The transistors 50 and 17*t* are thus turned on and the transistors 51, 52, and 16*t* are turned off as in FIG. 11A. The potential Vdata of the image signal Sig is applied to the wiring 21, and is applied to one electrode of the capacitor 18 through the transistor 50.

The transistor 16*t* is off and thus the gate of the transistor 15 is in a floating state. In addition, the threshold voltage Vth is held by the capacitor 18, and when the potential Vdata is applied to one electrode of the capacitor 18, the potential of the gate of the transistor 15 which is connected to the other electrode of the capacitor 18 becomes Vdata+Vth in accordance with the principle of conservation of charge. Moreover, the potential Vi1 of the wiring 22 is applied to one of the source and drain of the transistor 15 through the transistor 17*t*. The voltage Vdata−Vi1 is then applied to the capacitor 53 and the gate voltage of the transistor 15 becomes Vth+Vdata−Vi1.

During transition from the period t2 to t3, it is preferable that the potential applied to the wiring 55 be changed from high to low, and then, the potential applied to the wiring 56 be changed from low to high. This structure can prevent potential change of the gate of the transistor 15 due to change of the potential applied to the wiring 56.

In the next period t4, a low-level potential is applied to the wirings 54, 55, and 56, and a high-level potential is applied to the wiring 57. The transistor 52 is accordingly turned on and the transistors 50, 51, 16*t*, and 17*t* are turned off as in FIG. 11B.

The potential Vi2 and the potential Vcat are applied to the wiring 19 and the wiring 20, respectively.

Through the operation, the threshold voltage Vth, the voltage Vdata−Vi1 are held by the capacitor 18 and the capacitor 53, respectively; the potential of the anode of the light-emitting element 14 becomes the potential Ve1; the potential of the gate of the transistor 15 becomes the potential Vdata+Vth+Ve1−Vi1; and the gate voltage of the transistor 15 becomes Vdata+Vth−Vi1.

Note that the potential Ve1 is set when current flows to the light-emitting element 14 through the transistor 15. Specifically, the potential Ve1 is set to a potential between the potential Vi2 and the potential Vcat.

That is, the gate voltage of the transistor 15 can be the value to which the threshold voltage Vth is added. With this structure, variation of the threshold voltages Vth of the transistor 15 can be reduced, and variation of current values supplied to the light-emitting element 14 can be suppressed, whereby reducing unevenness in luminance of the light-emitting device.

Note that the potential applied to the wiring 57 is greatly varied here, whereby an influence of variation of threshold voltages of the transistor 52 on the value of a current supplied to the light-emitting element 14 can be prevented. In other words, the high-level potential applied to the wiring 57 is much higher than the threshold voltage of the transistor 52, and the low-level potential applied to the wiring 57 is much lower than the threshold voltage of the transistor 52 to secure switching of the transistor 52, so that the influence of variation of threshold voltages of the transistor 52 on the value of current supplied to the light-emitting element 14 can be prevented.

Figure 12:
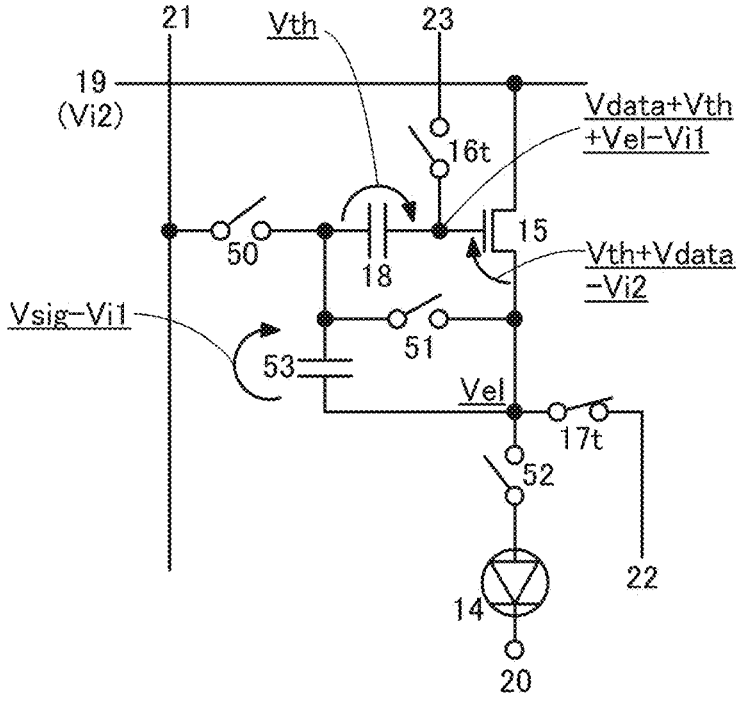
FIG. 12 schematically illustrates the operation of the pixel.

In the next period t5, a high-level potential is applied to the wirings 54 and a low-level potential is applied to the wirings 55, 56, and 57. The transistor 17*t* is accordingly turned on and the transistors 16*t*, 50, 51, and 52 are turned off as in FIG. 12.

The potential Vi2 is applied to the wiring 19, and the wiring 22 is connected to the monitor circuit.

By the above operation, a drain current Id of the transistor 15 flows into not the light-emitting element 14 but the wiring 22 through the transistor 17*t*. The monitor circuit generates a signal including information about the value of the drain current Id by using the drain current Id flowing through the wiring 22. Using the above signal, the light-emitting device according to one embodiment of the present invention can thus correct the value of the potential Vdata of the image signal VSig supplied to the pixel 11.

Note that in the light-emitting device including the pixel 11 illustrated in FIG. 8, the operation in the period t4 is not necessarily always performed after the operation in the period t3. For example, in the light-emitting device, the operation in the period t5 may be performed after the operations in the periods t1 to t4 are repeated a plurality of times. Alternatively, after the operation in the period t5 is performed on pixels 11 in one row, the light-emitting elements 14 may be brought into a non-light-emitting state by writing an image signal corresponding to the lowest gray-scale level 0 to the pixels 11 in the row which have been subjected to the above operation. Then, the operation in the period t4 may be performed on pixels 11 in the next row.

In the light-emitting device which includes the pixel 11 illustrated in FIG. 8, the other of the source and the drain of the transistor 15 is electrically separated from the gate of the transistor 15, so that their potentials can be individually controlled. The potential of the other of the source and the drain of the transistor 15 can be thus set higher than a value that is the sum of the potential of the gate of the transistor 15 and the threshold voltage Vth, in the period t2. When the transistor 15 is a normally-on transistor, that is, when the threshold voltage Vth is negative, charge can be accumulated in the capacitor 18 until the potential of the source of the transistor 15 becomes higher than the potential V1 of the gate of the transistor 15. For these reasons, in the light-emitting device according to one embodiment of the present invention, even when the transistor 15 is a normally on transistor, the threshold voltage can be obtained in the period t2; and in the period t4, the gate voltage of the transistor 15 can be set to a value obtained by adding the threshold voltage Vb.

In the light-emitting device according to one embodiment of the present invention, display unevenness can be reduced and high-quality images can be displayed even if the transistor 15 including a semiconductor film containing an oxide semiconductor, for example, becomes normally on.

<Configuration Example of Monitor Circuit>

Figure 13:
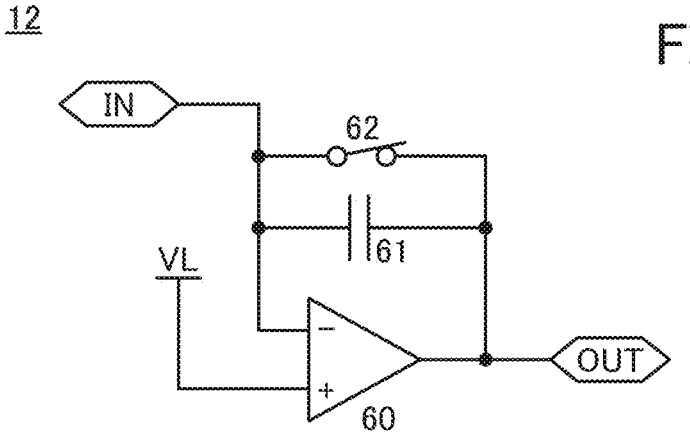
FIG. 13 is a circuit diagram of a monitor circuit.

Next, a configuration example of the monitor circuit 12 is illustrated in FIG. 13. The monitor circuit 12 illustrated in FIG. 13 includes an operational amplifier 60, a capacitor 61, and a switch 62.

One of a pair of electrodes of the capacitor 61 is connected to an inverting input terminal (−) of the operational amplifier 60, and the other of the pair of electrodes of the capacitor 61 is connected to an output terminal of the operation amplifier 60. The switch 62 has a function of releasing charge accumulated in the capacitor 61, and specifically has a function of controlling electrical connection between the pair of electrodes of the capacitor 61. A bias potential VL is supplied to a non-inverting input terminal (+) of the operational amplifier 60.

In the monitor circuit 12 in FIG. 13, when the switch 62 is off and the drain current extracted from the pixel 11 is supplied to an input terminal IN of the monitor circuit 12, charge is accumulated in the capacitor 61, so that voltage is generated between the pair of electrodes of the capacitor 61. The voltage is proportional to the total amount of the drain current supplied to the input terminal IN, and a potential corresponding to the total amount of the drain current in a predetermined period is applied to the wiring OUT.

<Cross-Sectional Structure of Light-Emitting Device>

Figure 14:
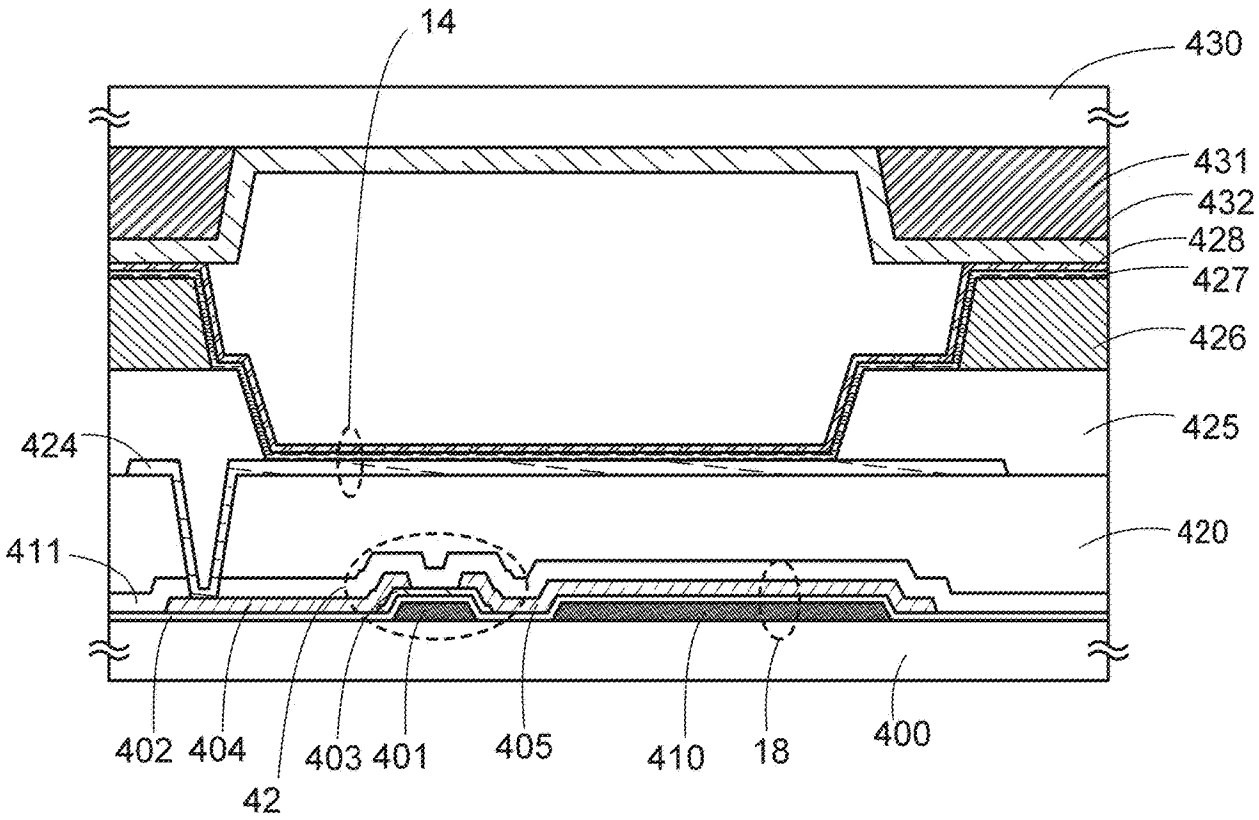
FIG. 14 is a cross-sectional view of a light-emitting device.

FIG. 14 illustrates, as an example, a cross-sectional structure of a pixel portion in a light-emitting device according to one embodiment of the present invention. Note that FIG. 14 illustrates the cross-sectional structures of the transistor 42, the capacitor 18, and the light-emitting element 14 illustrated in FIG. 4.

Specifically, the light-emitting device in FIG. 14 includes the transistor 42 and the capacitor 18 over a substrate 400. The transistor 42 includes a conductive film 401 that functions as a gate; an insulating film 402 over the conductive film 401; a semiconductor film 403 that overlaps with the conductive film 401 with the insulating film 402 positioned therebetween; and conductive films 404 and 405 that function as a source and a drain electrically connected to the semiconductor film 403.

The capacitor 18 includes the conductive film 410 that functions as an electrode; the insulating film 402 over the conductive film 410; and the conductive film 405 that overlaps with the conductive film 410 with the insulating film 402 positioned therebetween and functions as an electrode.

The insulating film 402 may be formed as a single layer or a stacked layer using one or more insulating films containing any of aluminum oxide, magnesium oxide, silicon oxide, silicon oxynitride, silicon nitride oxide, silicon nitride, gallium oxide, germanium oxide, yttrium oxide, zirconium oxide, lanthanum oxide, neodymium oxide, hafnium oxide, and tantalum oxide. Note that in this specification, "oxynitride" refers to a material that contains oxygen at a higher proportion than nitrogen, and "nitride oxide" refers to a material that contains nitrogen at a higher proportion than oxygen.

An insulating film 411 is provided over the semiconductor film 403 and the conductive films 404 and 405. In the case where an oxide semiconductor is used for the semiconductor film 403, it is preferable that a material that can supply oxygen to the semiconductor film 403 be used for the insulating film 411. By using the material for the insulating film 411, oxygen contained in the insulating film 411 can be moved to the semiconductor film 403, and the amount of oxygen vacancy in the semiconductor film 403 can be reduced. Oxygen contained in the insulating film 411 can be moved to the semiconductor film 403 efficiently by heat treatment performed after the insulating film 411 is formed.

An insulating film 420 is provided over the insulating film 411, and a conductive Film 424 is provided over the insulating film 420. The conductive film 424 is connected to the conductive film 404 through an opening formed in the insulating films 411 and 420.

An insulating film 425 is provided over the insulating film 420 and the conductive film 424. The insulating film 425 has an opening that overlaps with the conductive film 424. Over the insulating film 425, an insulating film 426 is provided in a position that is different from the position of the opening of the insulating film 425. An EL layer 427 and a conductive film 428 are sequentially stacked over the insulating films 425 and 426. A portion in which the conductive films 424 and 428 overlap with each other with the EL layer 427 positioned therebetween functions as the light-emitting element 14. One of the conductive films 424 and 428 functions as an anode, and the other functions as a cathode. An EL layer 427 and a conductive film 428 are sequentially stacked over the insulating films 425 and 426. A portion in which the conductive films 424 and 428 overlap with each other with the EL layer 427 positioned therebetween functions as the light-emitting element 14. One of the conductive films 424 and 428 functions as an anode, and the other functions as a cathode.

The light-emitting device includes a substrate 430 that faces the substrate 400 with the light-emitting element 14 positioned therebetween. A blocking film 431 that has a function of blocking light is provided over the substrate 430, i.e., over a surface of the substrate 430 that is close to the light-emitting element 14. In the opening that overlaps the light-emitting element 14, a coloring layer 432 that transmits visible light in a specific wavelength range is provided over the substrate 430.

<Structure of Transistor>

Next, a structure of a transistor 70 that includes a channel formation region in an oxide semiconductor film is described as an example.

Figure 15A:
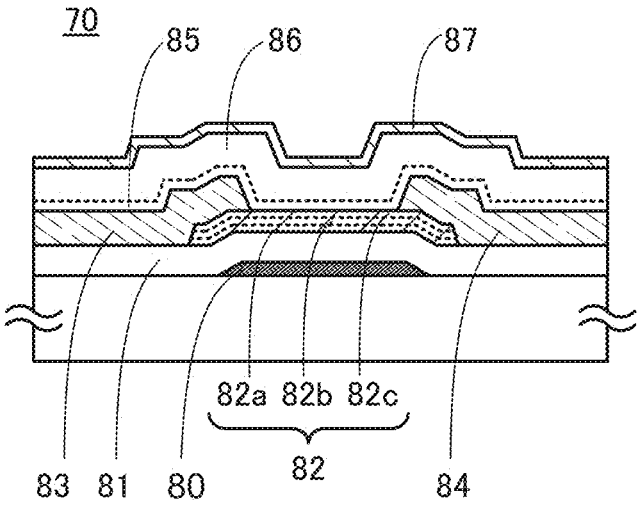
FIGS. 15A and 15B are cross-sectional views of a transistor.

The transistor 70 in FIG. 15A includes a conductive film 80 that functions as a gate; an insulating film 81 over the conductive film 80; an oxide semiconductor film 82 that overlaps with the conductive film 80 with the insulating film 81 positioned therebetween; and conductive films 83 and 84 that function as a source and a drain connected to the oxide semiconductor film 82. The transistor 70 in FIG. 15A further includes insulating films 85 to 87 sequentially stacked over the oxide semiconductor film 82 and the conductive films 83 and 84.

Note that in FIG. 15A, the insulating films 85 to 87 are sequentially stacked over the oxide semiconductor film 82 and the conductive films 83 and 84; however, the number of insulating films provided over the oxide semiconductor film 82 and the conductive films 83 and 84 may be one or three or more.

The insulating film 86 preferably contains oxygen at a proportion higher than or equal to the stoichiometric composition and has a function of supplying part of oxygen to the oxide semiconductor film 82 by heating. Further, the insulating film 86 preferably has a few defects, and typically the spin density at g=2.001 due to a dangling bond of silicon is preferably lower than or equal to $1\times10^{18}$ spins/cm$^3$ when measured by ESR. Note that in the case where the insulating film 86 is directly provided on the oxide semiconductor film 82 and the oxide semiconductor film 82 is damaged at the time of formation of the insulating film 86, the insulating film 85 is preferably provided between the oxide semiconductor film 82 and the insulating film 86, as illustrated in FIG. 15A. The insulating film 85 preferably causes little damage to the oxide semiconductor film 82 when the insulating film 85 is formed compared with the case of the insulating film 86 and has a function of allowing oxygen to pass therethrough. If damage to the oxide semiconductor film 82 can be reduced and the insulating film 86 can be formed directly on the oxide semiconductor film 82, the insulating film 85 is not necessarily provided.

The insulating film 85 preferably has a few defects, and typically the spin density at g=2.001 due to a dangling bond of silicon is preferably lower than or equal to $3\times10^{17}$ spins/cm$^3$ when measured by ESR. This is because if the density of defects in the insulating film 85 is high, oxygen is bonded to the defects and the amount of oxygen that permeates the insulating film 85 is decreased.

Furthermore, the interface between the insulating film 85 and the oxide semiconductor film 82 preferably has a few defects, and typically the spin density at g=1.89 to 1.96 due to oxygen vacancies in an oxide semiconductor used for the oxide semiconductor film 82 is preferably lower than or equal to $1\times10^{17}$ spins/cm$^3$, more preferably lower than or equal to the lower detection limit when measured by ESR where a magnetic field is applied parallel to a film surface.

The insulating film 87 preferably has an effect of blocking diffusion of oxygen, hydrogen, and water. Alternatively, the insulating film 87 preferably has an effect of blocking diffusion of hydrogen and water.

As an insulating film has higher density and becomes denser or has a fewer dangling bonds and becomes more chemically stable, the insulating film has a higher blocking effect. An insulating film that has an effect of blocking diffusion of oxygen, hydrogen, and water can be formed using, for example, aluminum oxide, aluminum oxynitride, gallium oxide, gallium oxynitride, yttrium oxide, yttrium oxynitride, hafnium oxide, or hafnium oxynitride. An insulating film that has an effect of blocking diffusion of hydrogen and water can be formed using, for example, silicon nitride or silicon nitride oxide.

In the case where the insulating film 87 has an effect of blocking diffusion of water, hydrogen, and the like, impurities such as water and hydrogen that exist in a resin in a panel or exist outside the panel can be prevented from entering the oxide semiconductor film 82. Since an oxide semiconductor is used for the oxide semiconductor film 82, part of water or hydrogen entering the oxide semiconductor serves as an electron donor (donor). Thus, the use of the insulating film 87 having the blocking effect can prevent a shift in threshold voltage of the transistor 70 due to generation of donors.

In addition, since an oxide semiconductor is used for the oxide semiconductor film 82, when the insulating film 87 has an effect of blocking diffusion of oxygen, diffusion of oxygen from the oxide semiconductor to the outside can be prevented. Accordingly, oxygen vacancies in the oxide semiconductor that serve as donors are reduced, so that a shift in threshold voltage of the transistor 70 due to generation of donors can be prevented.

Note that FIG. 15A illustrates an example in which the oxide semiconductor film 82 is formed using a stack of three oxide semiconductor films. Specifically, in the transistor 70 in FIG. 15A, the oxide semiconductor film 82 is formed by stacking oxide semiconductor films 82*a* to 82*c* sequentially from the insulating film 81 side. The oxide semiconductor film 82 of the transistor 70 is not limited to a stack of a plurality of oxide semiconductor films, and may be a single oxide semiconductor film.

The oxide semiconductor films 82*a* and 82*c* are each an oxide film that contains at least one of metal elements contained in the oxide semiconductor film 82*b*. The energy at the bottom of the conduction band of the oxide semiconductor films 82*a* and 82*c* is closer to a vacuum level than that of the oxide semiconductor film 82*b* by 0.05 eV or more, 0.07 eV or more. 0.1 eV or more, or 0.15 eV or more and 2 eV or less, 1 eV or less, 0.5 eV or less, or 0.4 eV or less. The oxide semiconductor film 82*b* preferably contains at least indium in order to increase carrier mobility.

Figure 15B:
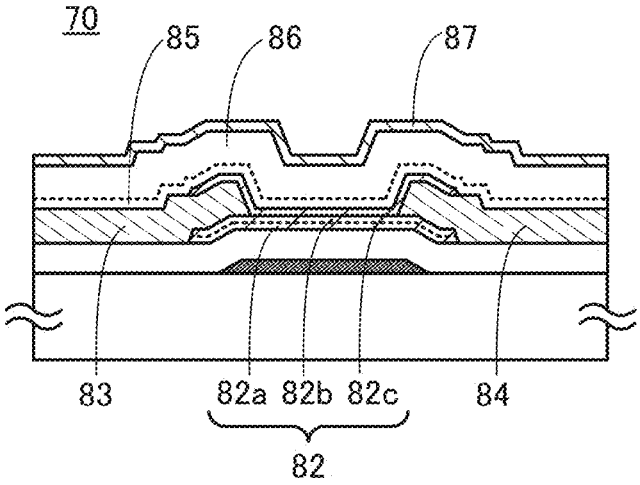

As illustrated in FIG. 15B, over the conductive films 83 and 84, the oxide semiconductor film 82*c* of the transistor 70 may overlap with the insulating film 85.

There are a few carrier generation sources in a highly purified oxide semiconductor (purified oxide semiconductor) obtained by reduction of impurities such as moisture and hydrogen serving as electron donors (donors) and reduction of oxygen vacancies; therefore, the highly purified oxide semiconductor can be an intrinsic (i-type) semiconductor or a substantially i-type semiconductor. Thus, a transistor including a channel formation region in a highly purified oxide semiconductor film has extremely low off-state current and high reliability. Thus, a transistor in which a channel formation region is formed in the oxide semiconductor film is likely to have positive threshold voltage (normally-off characteristics).

Specifically, various experiments can prove low off-state current of a transistor including a channel formation region in a highly purified oxide semiconductor film. For example, the off-state current of even an element having a channel width of $1\times10^6$ μm and a channel length of 10 μm can be less than or equal to the measurement limit of a semiconductor parameter analyzer, that is, less than or equal to $1\times10^{-13}$ A at a voltage between the source electrode and the drain electrode (a drain voltage) of 1 V to 10 V. In this case, it can be seen that off-state current normalized by the channel width of the transistor is less than or equal to 100 zA/μm. In addition, the off-state current is measured using a circuit in which a capacitor and a transistor are connected to each other and charge flowing into or from the capacitor is controlled by the transistor. In the measurement, a highly purified oxide semiconductor film is used for a channel formation region of the transistor, and the off-state current of the transistor is measured from a change in the amount of charge of the capacitor per unit time. As a result, it is found that, in the case where the voltage between the source electrode and the drain electrode of the transistor is 3 V, a lower off-state current of several tens of yA/μm is obtained. Consequently, the off-state current of the transistor in which a highly purified oxide semiconductor is used for a channel formation region is much lower than that of a transistor including crystalline silicon.

In the case where an oxide semiconductor film is used as a semiconductor film, at least indium (In) or zinc (Zn) is preferably included as an oxide semiconductor. In addition, as a stabilizer for reducing the variation in electrical characteristics of a transistor using the oxide semiconductor, it is preferable that gallium (Ga) be additionally contained. Tin (Sn) is preferably contained as a stabilizer. Hafnium (Hf) is preferably contained as a stabilizer. Aluminum (Al) is preferably contained as a stabilizer. Zirconium (Zr) is preferably contained as a stabilizer.

Among the oxide semiconductors, unlike silicon carbide, gallium nitride, or gallium oxide, an In—Ga—Zn-based oxide, an In—Sn—Zn-based oxide, or the like has an advantage of high mass productivity because a transistor with favorable electrical characteristics can be formed by a sputtering method or a wet process. Further, unlike silicon carbide, gallium nitride, or gallium oxide, with the use of the In—Ga—Zn-based oxide, a transistor with favorable electrical characteristics can be formed over a glass substrate. Further, a larger substrate can be used.

As another stabilizer, one or more lanthanoids selected from lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu) may be contained.

As the oxide semiconductor, for example, an indium oxide, a gallium oxide, a tin oxide, a zinc oxide, an In—Zn-based oxide, a Sn—Zn-based oxide, an Al—Zn-based oxide, a Zn—Mg-based oxide, a Sn—Mg-based oxide, an In—Mg-based oxide, an In—Ga-based oxide, an In—Ga—Zn-based oxide (also referred to as IGZO), an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—La—Zn-based oxide, an In—Pr—Zn-based oxide, an In—Nd—Zn-based oxide, an In—Ce—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, or an In—Hf—Al—Zn-based oxide can be used.

Note that, for example, an In—Ga—Zn-based oxide means an oxide containing In, Ga, and Zn, and there is no limitation on the ratio of In:Ga:Zn. In addition, the oxide may contain a metal element other than In, Ga, and Zn. The In—Ga—Zn-based oxide has sufficiently high resistance when no electric field is applied thereto, so that off-state current can be sufficiently reduced. Further, the In—Ga—Zn-based oxide has high mobility.

For example, with the In—Sn—Zn-based oxide, a high mobility can be relatively easily obtained. However, mobility can be increased by reducing the defect density in the bulk also in the case of using the In—Ga—Zn-based oxide.

A structure of an oxide semiconductor film is described below.

An oxide semiconductor film is classified roughly into a single crystal oxide semiconductor film and a non-single-crystal oxide semiconductor film. The non-single-crystal oxide semiconductor film includes any of an amorphous oxide semiconductor film, a microcrystalline oxide semiconductor film, a polycrystalline oxide semiconductor film, a CAAC-OS film, and the like.

The amorphous oxide semiconductor film has disordered atomic arrangement and no crystalline component. A typical example thereof is an oxide semiconductor film in which no crystal part exists even in a microscopic region, and the whole of the film is amorphous.

The microcrystalline oxide semiconductor film includes a microcrystal (also referred to as nanocrystal) with a size greater than or equal to 1 nm and less than 10 nm, for example. Thus, the microcrystalline oxide semiconductor film has a higher degree of atomic order than the amorphous oxide semiconductor film. Hence, the density of defect states of the microcrystalline oxide semiconductor film is lower than that of the amorphous oxide semiconductor film.

The CAAC-OS film is one of oxide semiconductor films including a plurality of crystal parts, and most of the crystal parts each fit inside a cube whose one side is less than 100 nm. Thus, there is a case where a crystal part included in the CAAC-OS film fits inside a cube whose one side is less than 10 nm, less than 5 nm, or less than 3 nm. The density of defect states of the CAAC-OS film is lower than that of the microcrystalline oxide semiconductor film. In a transmission electron microscope (TEM) image of the CAAC-OS film, a boundary between crystal parts, that is, a grain boundary is not clearly observed. Thus, in the CAAC-OS film, a reduction in electron mobility due to the grain boundary is less likely to occur.

According to the TEM image of the CAAC-OS film observed in a direction substantially parallel to a sample surface (cross-sectional TEM image), metal atoms are arranged in a layered manner in the crystal parts. Each metal atom layer has a morphology reflecting a surface where the CAAC-OS film is formed (hereinafter, a surface where the CAAC-OS film is formed is also referred to as a formation surface) or a top surface of the CAAC-OS film, and is arranged to be parallel to the formation surface or the top surface of the CAAC-OS film.

In this specification, the term "parallel" indicates that the angle formed between two straight lines is greater than or equal to −10° and less than or equal to 10°, and accordingly also includes the case where the angle is greater than or equal to −5° and less than or equal to 5°. In addition, the term "perpendicular" indicates that the angle formed between two straight lines is greater than or equal to 80° and less than or equal to 100°, and accordingly also includes the case where the angle is greater than or equal to 85° and less than or equal to 95°.

On the other hand, according to a TEM image of the CAAC-OS film observed in a direction substantially perpendicular to the sample surface (plan TEM image), metal atoms are arranged in a triangular or hexagonal configuration in the crystal parts. However, there is no regularity of arrangement of metal atoms between different crystal parts.

From the results of the cross-sectional TEM image and the plan TEM image, alignment is found in the crystal parts in the CAAC-OS film.

A CAAC-OS film is subjected to structural analysis with an X-ray diffraction (XRD) apparatus. For example, when the CAAC-OS film including an $InGaZnO_4$ crystal is analyzed by an out-of-plane method, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

On the other hand, when the CAAC-OS film is analyzed by an in-plane method in which an X-ray enters a sample in a direction substantially perpendicular to the c-axis, a peak appears frequently when 2θ is around 56°. This peak is derived from the (110) plane of the $InGaZnO_4$ crystal. Here, analysis (ϕ scan) is performed under conditions where the sample is rotated around a normal vector of a sample surface as an axis (ϕ axis) with 2θ fixed at around 56°. In the case where the sample is a single crystal oxide semiconductor film of $InGaZnO_4$, six peaks appear. The six peaks are derived from crystal planes equivalent to the (110) plane. On the other hand, in the case of a CAAC-OS film, a peak is not clearly observed even when ϕ scan is performed with 2θ fixed at around 56°.

According to the above results, in the CAAC-OS film having c-axis alignment, while the directions of a-axes and b-axes are different between crystal parts, the c-axes are aligned in a direction parallel to a normal vector of a formation surface or a normal vector of a top surface. Thus, each metal atom layer arranged in a layered manner observed in the cross-sectional TEM image corresponds to a plane parallel to the a-b plane of the crystal.

Note that the crystal part is formed concurrently with deposition of the CAAC-OS film or is formed through crystallization treatment such as heat treatment. As described above, the c-axis of the crystal is aligned in a direction parallel to a normal vector of a formation surface or a normal vector of a top surface of the CAAC-OS film. Thus, for example, in the case where a shape of the CAAC-OS film is changed by etching or the like, the c-axis might not be necessarily parallel to a normal vector of a formation surface or a normal vector of a top surface of the CAAC-OS film.

Further, the degree of crystallinity in the CAAC-OS film is not necessarily uniform. For example, in the case where crystal growth leading to the CAAC-OS film occurs from the vicinity of the top surface of the film, the degree of the crystallinity in the vicinity of the top surface is higher than that in the vicinity of the formation surface in some cases. Further, when an impurity is added to the CAAC-OS film, the crystallinity in a region to which the impurity is added is changed, and the degree of crystallinity in the CAAC-OS film varies depending on regions.

Note that when the CAAC-OS film with an $InGaZnO_4$ crystal is analyzed by an out-of-plane method, a peak of 2θ may also be observed at around 36°, in addition to the peak of 2θ at around 31°. The peak of 2θ at around 36° indicates that a crystal having no c-axis alignment is included in part of the CAAC-OS film. It is preferable that in the CAAC-OS film, a peak of 2θ appear at around 31° and a peak of 2θ not appear at around 36°.

With use of the CAAC-OS film in a transistor, a variation in the electrical characteristics of the transistor due to irradiation with visible light or ultraviolet light is small. Thus, the transistor has high reliability.

Note that an oxide semiconductor film may be a stacked film including two or more kinds of an amorphous oxide semiconductor film, a microcrystalline oxide semiconductor film, and a CAAC-OS film, for example.

For the deposition of the CAAC-OS film, the following conditions are preferably used.

By reducing the amount of impurities entering the CAAC-OS film during the deposition, the crystal state can be prevented from being broken by the impurities. For example, the concentration of impurities (e.g., hydrogen, water, carbon dioxide, or nitrogen) which exist in a treatment chamber may be reduced. Furthermore, the concentration of impurities in a deposition gas may be reduced. Specifically, a deposition gas whose dew point is −80° C. or lower, preferably −100° C. or lower is used.

By increasing the substrate heating temperature during the deposition, migration of a sputtered particle is likely to occur after the sputtered particle reaches a substrate surface. Specifically, the substrate heating temperature during the deposition is higher than or equal to 100° C. and lower than or equal to 740° C., preferably higher than or equal to 200° C. and lower than or equal to 500° C. By increasing the substrate heating temperature during the deposition, when the flat-plate-like sputtered particle reaches the substrate, migration occurs on the substrate surface, so that a flat plane of the sputtered particle is attached to the substrate.

Furthermore, preferably, the proportion of oxygen in the deposition gas is increased and the power is optimized in order to reduce plasma damage at the deposition. The proportion of oxygen in the deposition gas is 30 vol % or higher, preferably 100 vol %.

As an example of the target, an In—Ga—Zn-based oxide target is described below.

The In—Ga—Zn-based oxide target, which is polycrystalline, is made by, mixing $InO_X$ powder, $GaO_Y$ powder, and $ZnO_Z$ powder in a predetermined molar ratio, applying pressure, and performing heat treatment at a temperature higher than or equal to 1000° C. and lower than or equal to 1500° C. Note that X, Y, and Z are given positive numbers. Here, the predetermined molar ratio of $InO_X$ powder to $GaO_Y$ powder and $ZnO_Z$ powder is, for example, 2:2:1, 8:4:3, 3:1:1, 1:1:1, 4:2:3, 1:4:4, or 3:1:2. The kinds of powders and the molar ratio for mixing powders may be determined as appropriate depending on the desired target.

An alkali metal is not an element included in an oxide semiconductor and thus is an impurity. Likewise, an alkaline earth metal is an impurity when the alkaline earth metal is not a component of the oxide semiconductor. When an insulating film in contact with an oxide semiconductor film is an oxide, Na, among the alkali metals, diffuses into the insulating film and becomes $Na^+$. Further, in the oxide semiconductor film, Na cuts or enters a bond between metal and oxygen which are components of the oxide semiconductor. As a result, the electrical characteristics of the transistor deteriorate; for example, the transistor is placed in a normally-on state due to a negative shift of the threshold voltage or the mobility is decreased. In addition, the characteristics of transistors vary. Specifically, the measurement value of a Na concentration by secondary ion mass spectrometry is preferably $5\times10^{16}/cm^3$ or lower, further preferably $1\times10^{16}/cm^3$ or lower, still further preferably $1\times10^{15}/cm^3$ or lower. Similarly, the measurement value of a Li concentration is preferably $5\times10^{15}/cm^3$ or lower, further preferably $1\times10^{15}/cm^3$ or lower. Similarly, the measurement value of a K concentration is preferably $5\times10^{15}/cm^3$ or lower, further preferably $1\times10^{15}/cm^3$ or lower.

When metal oxide containing indium is used, silicon or carbon having higher bond energy with oxygen than indium might cut the bond between indium and oxygen, so that an oxygen vacancy may be formed. Accordingly, when silicon or carbon is contained in the oxide semiconductor film, the electrical characteristics of the transistor are likely to deteriorate as in the case of using an alkali metal or an alkaline earth metal. Thus, the concentrations of silicon and carbon in the oxide semiconductor film are preferably low. Specifically, the carbon concentration or the silicon concentration measured by secondary ion mass spectrometry is $1\times10^{18}/cm^3$ or lower. In this case, the deterioration of the electrical characteristics of the transistor can be prevented, so that the reliability of a semiconductor device can be improved.

A metal in the source electrode and the drain electrode might extract oxygen from the oxide semiconductor film depending on a conductive material used for the source and drain electrodes. In such a case, a region of the oxide semiconductor film in contact with the source electrode or the drain electrode becomes an n-type region due to the formation of an oxygen vacancy.

The n-type region serves as a source region or a drain region, resulting in a decrease in the contact resistance between the oxide semiconductor film and the source electrode or the drain electrode. Accordingly, the formation of the n-type region increases the mobility and on-state current of the transistor, which achieves high-speed operation of a semiconductor device using the transistor.

Note that the extraction of oxygen by a metal in the source electrode and the drain electrode is probably caused when the source electrode and the drain electrode are formed by a sputtering method or the like or when heat treatment is performed after the formation of the source electrode and the drain electrode.

The n-type region is more likely to be formed when the source and drain electrodes are formed using a conductive material that is easily bonded to oxygen. Examples of such a conductive material include Al, Cr, Cu, Ta, Ti, Mo, and W.

The oxide semiconductor film is not limited to a single metal oxide film and may have a stacked structure of a plurality of metal oxide films. In a semiconductor film in which first to third metal oxide films are sequentially stacked, for example, the first metal oxide film and the third metal oxide film are each an oxide film which contains at least one of the metal elements contained in the second metal oxide film and whose energy at the bottom of the conduction band is closer to the vacuum level than that of the second metal oxide film by 0.05 eV or more, 0.07 eV or more, 0.1 eV or more, or 0.15 eV or more and 2 eV or less, 1 eV or less, 0.5 eV or less, or 0.4 eV or less. Further, the second metal oxide film preferably contains at least indium in order to increase the carrier mobility.

In the transistor including the above semiconductor film, when a voltage is applied to the gate electrode so that an electric field is applied to the semiconductor film, a channel region is formed in the second metal oxide film, whose energy at the bottom of the conduction band is the lowest. That is, since the third metal oxide film is provided between the second metal oxide film and the gate insulating film, a channel region can be formed in the second metal oxide film which is insulated from the gate insulating film.

Since the third metal oxide film contains at least one of the metal elements contained in the second metal oxide film, interface scattering is unlikely to occur at the interface between the second metal oxide film and the third metal oxide film. Thus, the movement of carriers is unlikely to be inhibited at the interface, which results in an increase in the field-effect mobility of the transistor.

If an interface level is formed at the interface between the second metal oxide film and the first metal oxide film, a channel region is formed also in the vicinity of the interface, which causes a change in the threshold voltage of the transistor. However, since the first metal oxide film contains at least one of the metal elements contained in the second metal oxide film, an interface level is unlikely to be formed at the interface between the second metal oxide film and the first metal oxide film. Accordingly, the above structure can reduce variations in the electrical characteristics of the transistor, such as the threshold voltage.

Further, it is preferable that a plurality of metal oxide films be stacked so that an interface level due to impurities existing between the metal oxide films, which inhibits carrier flow, is not formed at the interface between the metal oxide films. This is because if impurities exist between the stacked metal oxide films, the continuity of the energy at the bottom of the conduction band between the metal oxide films is lost, and carriers are trapped or disappear by recombination in the vicinity of the interface. By reducing impurities existing between the films, a continuous junction (here, particularly a U-shape well structure with the energy at the bottom of the conduction band changed continuously between the films) is formed more easily than the case of merely stacking a plurality of metal oxide films that contain at least one common metal as a main component.

In order to form continuous junction, the films need to be stacked successively without being exposed to the air by using a multi-chamber deposition system (sputtering apparatus) provided with a load lock chamber. Each chamber of the sputtering apparatus is preferably evacuated to a high vacuum (to the degree of about $5\times10^{-7}$ Pa to $1\times10^{4}$ Pa) by an adsorption vacuum pump such as a cryopump so that water and the like acting as impurities for the oxide semiconductor film are removed as much as possible. Alternatively, a combination of a turbo molecular pump and a cold trap is preferably used to prevent back-flow of a gas from an exhaust system into a chamber.

Not only high vacuum evacuation in a chamber but also high purity of a sputtering gas is necessary to obtain a high-purity intrinsic oxide semiconductor. As an oxygen gas or an argon gas used as the sputtering gas, a gas that is highly purified to have a dew point of −40° C. or lower, preferably −80° C. or lower, more preferably −100° C. or lower is used, so that entry of moisture or the like into the oxide semiconductor film can be prevented as much as possible. Specifically, when the second metal oxide film contains an In-M-Zn oxide (M represents Ga, Y, Zr, La, Ce, or Nd) and a target having the atomic ratio of metal elements of In:M:Zn=$x_1$:$y_1$:$z_1$ is used for forming the second metal oxide film, $x_1/y_1$ is preferably greater than or equal to ⅓ and less than or equal to 6, further preferably greater than or equal to 1 and less than or equal to 6, and $z_1/y_1$ is preferably greater than or equal to ⅓ and less than or equal to 6, further preferably greater than or equal to 1 and less than or equal to 6. Note that when $z_1/y_1$ is greater than or equal to 1 and less than or equal to 6, a CAAC-OS film is easily formed as the second metal oxide film. Typical examples of the atomic ratio of the metal elements of the target are In:M:Zn=1:1:1, In:M:Zn=3:1:2, and the like.

Specifically, when the first metal oxide film and the third metal oxide film contain an In-M-Zn oxide (M represents Ga, Y, Zr, La, Ce, or Nd) and a target having the atomic ratio of metal elements of In:M:Zn=$x_2$:$y_2$:$z_2$ is used for forming the first metal oxide film and the third metal oxide film, $x_2/y_2$ is preferably less than and $z_2/y_2$ is preferably greater than or equal to ⅓ and less than or equal to 6, further preferably greater than or equal to 1 and less than or equal to 6. Note that when $z_2/y_2$ is greater than or equal to 1 and less than or equal to 6. CAAC-OS films are easily formed as the first metal oxide film and the third metal oxide film. Typical examples of the atomic ratio of the metal elements of the target are In:M:Zn=1:3:2, In:M:Zn=1:3:4, In:M:Zn=1:3:6, In:M:Zn=1:3:8, and the like.

The thickness of the first metal oxide film and the third metal oxide film is greater than or equal to 3 nm and less than or equal to 100 nm, preferably greater than or equal to 3 nm and less than or equal to 50 nm. The thickness of the second metal oxide film is greater than or equal to 3 nm and less than or equal to 200 nm, preferably greater than or equal to 3 nm and less than or equal to 100 nm, further preferably greater than or equal to 3 nm and less than or equal to 50 nm.

In the three-layer semiconductor film, the first to third metal oxide films can be amorphous or crystalline. Note that the transistor can have stable electrical characteristics when the second metal oxide film where a channel region is formed is crystalline; therefore, the second metal oxide film is preferably crystalline.

Note that a channel formation region refers to a region of a semiconductor film of a transistor that overlaps with a gate electrode and is located between a source electrode and a drain electrode. Further, a channel region refers to a region through which current mainly flows in the channel formation region.

For example, when an In—Ga—Zn-based oxide film formed by a sputtering method is used as the first and third metal oxide films, a target that is an In—Ga—Zn-based oxide containing In, Ga, and Zn at an atomic ratio of 1:3:2 can be used to deposit the first and third metal oxide films. The deposition conditions can be as follows, for example: an argon gas (flow rate: 30 sccm) and an oxygen gas (flow rate: 15 sccm) are used as the deposition gas the pressure is 0.4 Pa the substrate temperature is 200° C.; and the DC power is 0.5 kW.

Further, when the second metal oxide film is a CAAC-OS film, a target including polycrystalline In—Ga—Zn-based oxide containing In, Ga, and Zn at an atomic ratio of 1:1:1 is preferably used to deposit the second metal oxide film. The deposition conditions can be as follows, for example: an argon gas (flow rate: 30 sccm) and an oxygen gas (flow rate: 15 sccm) are used as the deposition gas; the pressure is 0.4 Pa; the substrate temperature is 300° C.; and the DC power is 0.5 kW.

Note that the end portions of the semiconductor film in the transistor may be tapered or rounded.

Also in the case where a semiconductor film including stacked metal oxide films is used in the transistor, a region in contact with the source electrode or the drain electrode may be an n-type region. Such a structure increases the mobility and on-state current of the transistor and achieves high-speed operation of a semiconductor device using the transistor. Further, when the semiconductor film including the stacked metal oxide films is used in the transistor, the n-type region particularly preferably reaches the second metal oxide film part of which is to be a channel region, because the mobility and on-state current of the transistor are further increased and higher-speed operation of the semiconductor device is achieved.

<Structure Example 1 of Electronic Device>

Figure 16A:
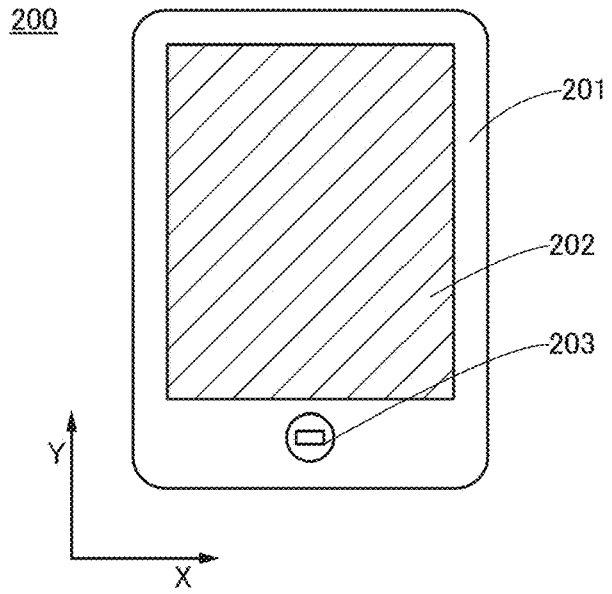
FIGS. 16A and 16B are a diagram of a portable information terminal and a flow chart of the operation

FIG. 16A illustrates a structure example of a portable information terminal 200 including the light-emitting device of one embodiment of the present invention. The portable information terminal 200 illustrated in FIG. 16A includes a housing 201, a display portion 202 supported by the housing 201, a power switch 203 which corresponds to an input device, and the like. The light-emitting device of one embodiment of the present invention can be used as the display portion 202. The light-emitting device of one embodiment of the present invention can reduce display unevenness and achieve high quality display, and is used as the display portion 202 to increase the visibility of the portable information terminal 200.

Note that the light-emitting device of one embodiment of the present invention may have a function of correcting image signals so that images can move in a direction opposite to vibration applied to the light-emitting device, in addition to a function of external correction for image signals to reduce display unevenness.

For example, when the portable information terminal 200 in FIG. 16A vibrates or jiggles in a direction indicated by an arrow X, an image displayed on the display portion 202 moves in the direction opposite to the arrow X. When the portable information terminal 200 in FIG. 16A vibrates or jiggles in a direction indicated by an arrow Y intersecting with the arrow X, an image displayed on the display portion 202 moves in the direction opposite to the arrow X.

The moving distance of the image by correction is preferably close to the moving distance of the portable information terminal 200 by the vibration applied to the portable information terminal 200.

When the light-emitting device vibrates, image signals are corrected in the above-described manner to reduce image blurring for viewers looking at the light-emitting device. The visibility of the portable information terminal 200 can be thus increased.

Information on the vibration direction of the light-emitting device or the moving distance by the vibration can be obtained using a vibration sensor for converting vibration into an electrical signal. As the vibration sensor, an acceleration sensor, a charge coupled device (CCD), or the like can be used.

Figure 16B:
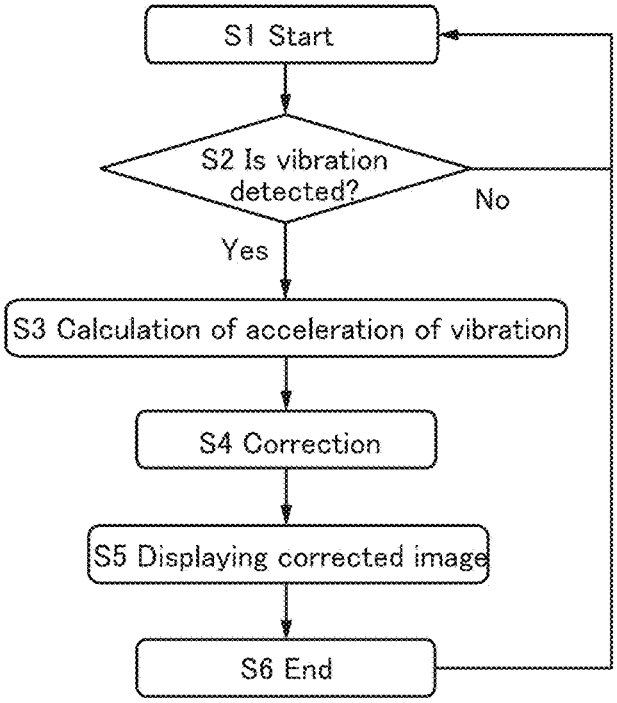

FIG. 16B is a flowchart of correction of image signals in the light-emitting device in the portable information terminal 200 including an acceleration sensor.

First, as in FIG. 16B, monitoring whether the portable information terminal 200 vibrates or not starts (S1: Start of monitoring of vibration). Then, whether vibration is detected or not is determined (S2: Is vibration detected?). When no vibration is detected, monitoring of vibration applied to the portable information terminal 200 starts again at some interval or no interval (S1: Start of monitoring of vibration).

When vibration is detected, an acceleration of the applied vibration in each direction is calculated (S3: Calculation of acceleration of vibration in each direction). A reference point is determined on a display of the light-emitting device in the display portion 202 to obtain an acceleration ax in an X direction and an acceleration ay in a Y direction from the reference point.

The obtained acceleration is then used to correct image signals (S4: Correction of image signal). Let time for measuring acceleration be t, image signals may be corrected so that an image moves in the X direction by $-ax \times t$ and in the Y direction by $-ay \times t$, for example.

Finally, an image is displayed using the corrected image signals (S5: Displaying corrected image) and vibration monitoring is completed (S6: Completion of vibration monitoring).

<External View of Light-Emitting Device>

Figure 17:
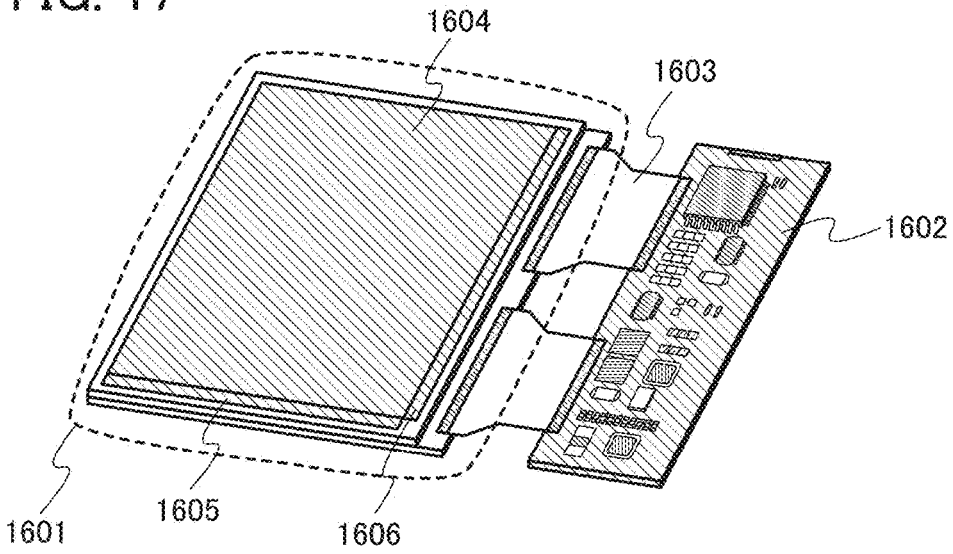
FIG. 17 is a perspective view of a light-emitting device.

FIG. 17 is a perspective view illustrating an example of an external view of a light-emitting device (a display module) according to one embodiment of the present invention. The light-emitting device illustrated in FIG. 17 includes a panel 1601; a circuit board 1602 including a controller, a power supply circuit, an image processing circuit, an image memory, a CPU, and the like; and a connection portion 1603. The panel 1601 includes a pixel portion 1604 including a plurality of pixels, a driver circuit 1605 that selects pixels row by row, and a driver circuit 1606 that controls input of an image signal Sig to the pixels in a selected row.

A variety of signals and power supply potentials are input from the circuit board 1602 to the panel 1601 through the connection portion 1603. As the connection portion 1603, a flexible printed circuit (FPC) or the like can be used. In the case where a COF tape is used as the connection portion 1603, part of circuits in the circuit board 1602 or part of the driver circuit 1605 or the driver circuit 1606 included in the panel 1601 may be formed on a chip separately prepared, and the chip may be connected to the COF tape by a chip-on-film (COF) method.

Note that a touch sensor may be provided over the panel 1601. The touch sensor may be formed over a different substrate from the panel 1601 or over the substrate included in the panel 1601.

<Structural Example of Electronic Device 2>

The light-emitting device according to one embodiment of the present invention can be used for display devices, notebook personal computers, or image reproducing devices provided with recording media (typically, devices which reproduce the content of recording media such as digital versatile discs (DVDs) and have displays for displaying the reproduced images). Other than the above, as an electronic device which can use the light-emitting device according to one embodiment of the present invention, cellular phones, portable game machines, portable information terminals, electronic books, cameras such as video cameras and digital still cameras, goggle-type displays (head mounted displays), navigation systems, audio reproducing devices (e.g., car audio systems and digital audio players), copiers, facsimiles, printers, multifunction printers, automated teller machines (ATM), vending machines, and the like can be given. Specific examples of these electronic devices are illustrated in FIGS. 18A to 18F.

Figure 18A:
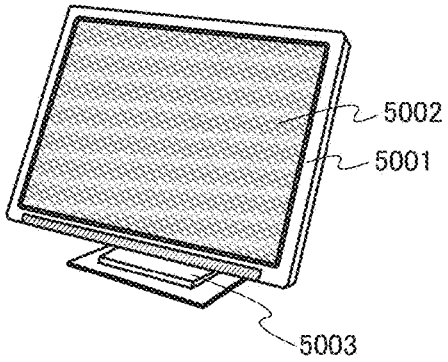
FIGS. 18A to 18F are diagrams illustrating electronic devices.

FIG. 18A illustrates a display device including a housing 5001, a display portion 5002, a supporting base 5003, and the like. The light-emitting device according to one embodiment of the present invention can be used for the display portion 5002. Note that the display device includes all devices for displaying information such as for a personal computer, for receiving TV broadcasting, and for displaying an advertisement.

Figure 18B:
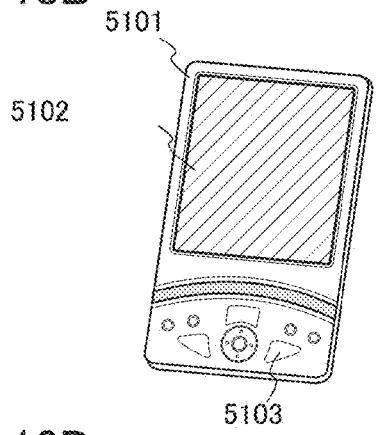

FIG. 18B illustrates a portable information terminal including a housing 5101, a display portion 5102, operation keys 5103, and the like. The light-emitting device according to one embodiment of the present invention can be used for the display portion 5102.

Figure 18C:
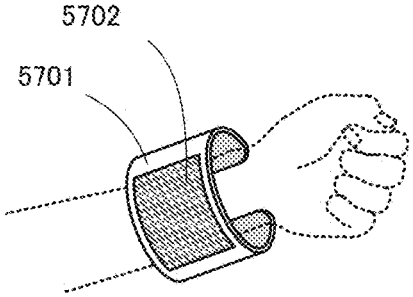

FIG. 18C illustrates a display device including a housing 5701 having a curved surface, a display portion 5702, and the like. When a flexible substrate is used for the light-emitting device according to one embodiment of the present invention, it is possible to use the light-emitting device as the display portion 5702 supported by the housing 5701 having a curved surface. Consequently, it is possible to provide a user-friendly display device that is flexible and lightweight.

Figure 18D:
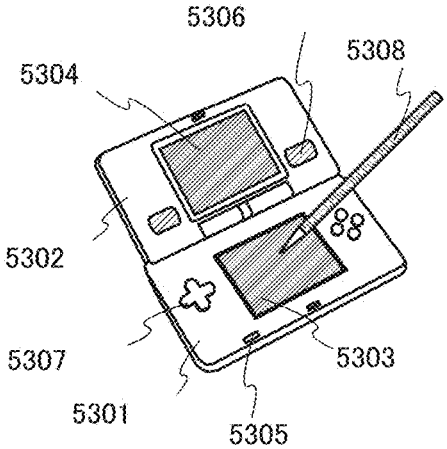

FIG. 18D illustrates a portable game machine including a housing 5301, a housing 5302, a display portion 5303, a display portion 5304, a microphone 5305, a speaker 5306, an operation key 5307, a stylus 5308, and the like. The light-emitting device according to one embodiment of the present invention can be used for the display portion 5303 or the display portion 5304. When the light-emitting device according to one embodiment of the present invention is used as the display portion 5303 or 5304, it is possible to provide a user-friendly portable game machine with quality that hardly deteriorates. Note that although the portable game machine illustrated in FIG. 18D includes the two display portions 5303 and 5304, the number of display portions included in the portable game machine is not limited to two.

Figure 18E:
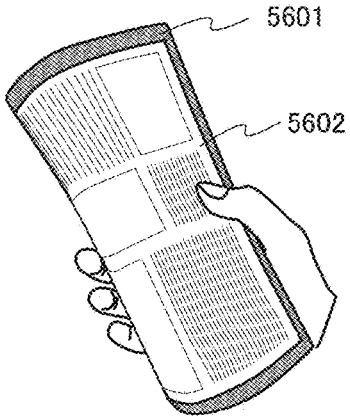

FIG. 18E illustrates an e-book reader, which includes a housing 5601, a display portion 5602, and the like. The light-emitting device according to one embodiment of the present invention can be used for the display portion 5602. When a flexible substrate is used, the light-emitting device can have flexibility, so that it is possible to provide a flexible and lightweight e-book reader.

Figure 18F:
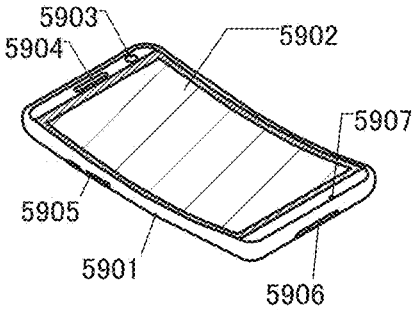

FIG. 18F illustrates a cellular phone, which includes a display portion 5902, a microphone 5907, a speaker 5904, a camera 5903, an external connection portion 5906, and an operation button 5905 in a housing 5901. It is possible to use the light-emitting device according to one embodiment of the present invention as the display portion 5902. When the light-emitting device according to one embodiment of the present invention is provided over a flexible substrate, the light-emitting device can be used as the display portion 5902 having a curved surface, as illustrated in FIG. 18F.

This application is based on Japanese Patent Application serial no. 2013-178817 filed with Japan Patent Office on Aug. 30, 2013, the entire contents of which are hereby incorporated by reference.

What is claimed is:

1. A light-emitting device comprising:

a pixel comprising a light-emitting element, a transistor, a first switch, a second switch, and a capacitor; and a circuit configured to correct an image signal input to the pixel, wherein the capacitor is configured to hold a potential difference between one of a source and a drain of the transistor and a gate of the transistor, wherein the gate of the transistor is electrically connected to a wiring through the first switch, wherein the one of the source and the drain of the transistor is electrically connected to the circuit through the second switch, wherein the light-emitting element is electrically connected to the one of the source and the drain of the transistor, and wherein a constant potential is applied to the wiring.

2. The light-emitting device according to claim 1, wherein the transistor is an n-channel transistor.

3. The light-emitting device according to claim 2, wherein the transistor includes a channel formation region in an oxide semiconductor film.

4. The light-emitting device according to claim 1, wherein the transistor is a first transistor, and wherein the first switch and the second switch each include a second transistor.

5. The light-emitting device according to claim 4, wherein the second transistor included in each of the first switch and the second switch is an n-channel transistor.

6. The light-emitting device according to claim 5, wherein the second transistor includes a channel formation region in an oxide semiconductor film.

7. A light-emitting device comprising:

a pixel;

a first circuit configured to generate a signal containing information on a value of current extracted from the pixel; and a second circuit configured to correct an image signal in accordance with the signal, wherein the pixel comprises:

a light-emitting element, a transistor for controlling supply of a current to the light-emitting element in accordance with the image signal, a first switch electrically connected to a gate of the transistor and a wiring, a second switch configured to control extraction of a current from the pixel, and wherein a constant potential is applied to the wiring.

8. The light-emitting device according to claim 7, wherein the transistor is an n-channel transistor.

9. The light-emitting device according to claim 8, wherein the transistor includes a channel formation region in an oxide semiconductor film.

10. The light-emitting device according to claim 7, wherein the transistor is a first transistor, and wherein the first switch and the second switch each include a second transistor.

11. The light-emitting device according to claim 10, wherein the second transistor included in each of the first switch and the second switch is an n-channel transistor.

12. The light-emitting device according to claim 11, wherein the second transistor includes a channel formation region in an oxide semiconductor film.

* * * * *